US008357248B2

(12) United States Patent
Aruga et al.

(10) Patent No.: US 8,357,248 B2
(45) Date of Patent: Jan. 22, 2013

(54) COPPER ALLOY HAVING HIGH STRENGTH, HIGH ELECTRIC CONDUCTIVITY AND EXCELLENT BENDING WORKABILITY

(75) Inventors: Yasuhiro Aruga, Kobe (JP); Akira Fugono, Shimonoseki (JP); Takeshi Kudo, Kobe (JP); Katsura Kajihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/491,911

(22) Filed: Jun. 8, 2012

(65) Prior Publication Data

US 2012/0288402 A1 Nov. 15, 2012

Related U.S. Application Data

(62) Division of application No. 12/297,069, filed as application No. PCT/JP2007/060526 on May 23, 2007, now Pat. No. 8,268,098.

(30) Foreign Application Priority Data

May 26, 2006 (JP) ..... 2006-147088
Sep. 22, 2006 (JP) ..... 2006-257534
Sep. 22, 2006 (JP) ..... 2006-257535

(51) Int. Cl.
*C22C 9/02* (2006.01)
*C22C 9/04* (2006.01)
*C22C 9/06* (2006.01)

(52) U.S. Cl. ..... 148/412; 148/413; 148/414

(58) Field of Classification Search ..... 148/412, 148/413, 414
See application file for complete search history.

(56) References Cited

U.S. PATENT DOCUMENTS 4,260,435 A 4/1981 Edens et al.
2005/0092404 A1 5/2005 Aruga et al.
2005/0161126 A1 7/2005 Aruga et al.
2005/0263218 A1 12/2005 Tanaka et al.
2006/0137773 A1 6/2006 Aruga et al.
(Continued)

FOREIGN PATENT DOCUMENTS

CN 1600881 A 3/2005
(Continued)

OTHER PUBLICATIONS

Office Action issued Nov. 5, 2010, in Korean Patent Application No. 10-2008-7026720 with English and Japanese translations.
(Continued)

*Primary Examiner* — Stuart Hendrickson
*Assistant Examiner* — Alexander Polyansky
(74) *Attorney, Agent, or Firm* — Oblon, Spivak, McClelland, Maier & Neustadt, L.L.P.

(57) ABSTRACT

A copper alloy having high strength, high electrical conductivity, and excellent bendability, the copper alloy containing, in terms of mass %, 0.4 to 4.0% of Ni; 0.05 to 1.0% of Si; and, as an element M, one member selected from 0.005 to 0.5% of P, 0.005 to 1.0% of Cr, and 0.005 to 1.0% of Ti, with the remainder being copper and inevitable impurities, in which an atom number ratio M/Si of elements M and Si contained in a precipitate having a size of 50 to 200 nm in a microstructure of the copper alloy is from 0.01 to 10 on average, the atom number ratio being measured by a field emission transmission electron microscope with a magnification of 30,000 and an energy dispersive analyzer. According to the invention, it is possible to provide a copper alloy having high strength, high electrical conductivity, and excellent bendability.

4 Claims, 4 Drawing Sheets

U.S. PATENT DOCUMENTS

| | | | |
|---|---|---|---|
| 2007/0148032 | A1 | 6/2007 | Aruga et al. |
| 2008/0025867 | A1 | 1/2008 | Aruga et al. |
| 2009/0101323 | A1 | 4/2009 | Takagi et al. |

FOREIGN PATENT DOCUMENTS

| | | | |
|---|---|---|---|
| EP | 0 579 278 | A2 | 1/1994 |
| EP | 0 579 278 | A3 | 1/1994 |
| GB | 2 219 473 | A | 12/1989 |
| JP | 5 279825 | | 10/1993 |
| JP | 8 225869 | | 9/1996 |
| JP | 9 209061 | | 8/1997 |
| JP | 2001 49369 | | 2/2001 |
| JP | 2001 207229 | | 7/2001 |
| JP | 2002 180161 | | 6/2002 |
| JP | 2002 266042 | | 9/2002 |
| JP | 2005 89843 | | 4/2005 |
| JP | 2005-290543 | | 10/2005 |
| JP | 2006 16629 | | 1/2006 |
| JP | 2006-16687 | | 1/2006 |
| JP | 2006 89763 | | 4/2006 |
| WO | WO 99/05331 | | 2/1999 |
| WO | WO 99/13117 | | 3/1999 |
| WO | WO 2005/083137 | A1 | 9/2005 |

OTHER PUBLICATIONS

U.S. Appl. No. 13/491,942 , filed Jun. 8, 2012, Aruga, et al.

COPPER ALLOY HAVING HIGH STRENGTH, HIGH ELECTRIC CONDUCTIVITY AND EXCELLENT BENDING WORKABILITY

TECHNICAL FIELD

The present invention relates to a Corson-based copper alloy having high strength, high electrical conductivity, and excellent bendability, and more particularly, to a copper alloy suitable for copper alloy sheets for use in semiconductor components such as IC lead frames for electric appliances and semiconductor devices, materials for electric/electronic components such as printed wiring boards, switch components, mechanical components such as bus-bars, terminals or connectors, and industrial instruments.

BACKGROUND ART

With the trend toward reduction of size and weight of electronic device, electric/electronic components are being made small and light. With such a trend toward the small and light electric/electronic components, the copper alloy materials to be used for terminals of the electric/electronic components are also made thinner and narrower in order to make the terminals small and light. For example, copper alloy sheets being used in ICs have a thickness of 0.1 to 0.15 mm.

As a result, the copper alloy material used for the electric/electronic components is required to have a higher strength. For example, copper alloy sheets to be used for connectors of vehicles are required to have such a high strength of 800 MPa or more.

Due to such a trend toward the thin and narrow electric/electronic components, the cross-sectional area of electrically conductive parts of the copper alloy material is decreased. In order to compensate for the decrease in the electrical conductivity due to the decreased cross-sectional area, the copper alloy material is required to have a satisfactory electrical conductivity of 40% IACS or more.

Additionally, the copper alloy sheets used for connectors, terminals, switches, relays, IC lead frames and the like are required to have excellent bendability (allowing 90° bending after a notching) as well as the high strength and the high electrical conductivity.

Conventionally, the 42 alloys (Fe-42 mass % Ni alloy) have been known as an example of a high-strength copper alloy material. The 42 alloys have a tensile strength of about 580 MPa, low anisotropy, and excellent bendability. However, the 42 alloys cannot satisfy high-strength requirement of 800 MPa or more. Further, the 42 alloys contain a large amount of Ni, and thus making the price expensive.

For this reason, the Corson alloys (Cu—Ni—Si-based alloy) that are excellent in the above-described properties and are also cheap are used for the electric/electronic components. The Corson alloys are alloys, in which a solid solubility limit of nickel silicide compound ($Ni_2Si$) with respect to a copper greatly varies depending on temperature, which are precipitation hardening-type alloys that are hardened by a quenching and tempering process, and which have satisfactory heat resistance and high-temperature strength. Accordingly, the Corson alloys are used for various types of springs for electrical conduction or power lines having high-tensile.

However, the electrical conductivity and bendability of the Corson alloys may deteriorate when the strength of the copper alloy material is increased. That is, it is very difficult to make the high-strength Corson alloys have satisfactory electrical conductivity and bendability. Hence, there is a desire for a further improvement in strength, electrical conductivity, and bendability of the Corson alloys.

There have been proposed several approaches to improve the strength, electrical conductivity, and bendability of the Corson alloys. For example, according to Patent Document 1, the contents of Sn, Zn, Fe, P, Mg, Pb, as well as Ni and Si are specified so as to improve the strength and punching workability as well as the electrical conductivity, while maintaining the solder ablation resistance, heat-resistant creep property, migration resistance property, and hot workability of a bending portion.

According to Patent Document 2, the contents of Mg as well as Ni and Si and the number of precipitates and inclusions having a grain size of 10 μm or more, which are contained in the alloy, are specified so as to improve the electrical conductivity, strength, and high-temperature strength of the resulting alloy.

According to Patent Document 3, the contents of Mg and S as well as Ni and Si while controlling the content ratio of S are specified so as to suitably improve the strength, electrical conductivity, bendability, stress relaxation property, plate adhesion of the resulting alloy.

According to Patent Document 4, the content of Fe is controlled to be 0.1% or less and thus to improve the strength, electrical conductivity, and bendability of the resulting alloy.

According to Patent Document 5, the size of inclusions is controlled to be 10 μm or less and the number of inclusions having a grain size of 5 to 10 μm is controlled so as to improve the strength, electrical conductivity, bendability, etching property, and plating property of the resulting alloy.

According to Patent Document 6, the dispersion state of $Ni_2Si$ precipitates is controlled so as to improve the strength, electrical conductivity, and bendability of the resulting alloy.

According to Patent Document 7, a stretching shape of a grain of microstructures on the surface of the copper alloy sheet is specified so as to improve the abrasion-resistant property of the resulting alloy.

Patent Document 1: JP-A-9-209061
Patent Document 2: IP-A-8-225869
Patent Document 3: JP-A-2002-180161
Patent Document 4: JP-A-2001-207229
Patent Document 5: JP-A-2001-49369
Patent Document 6: JP-A-2005-89843
Patent Document 7: JP-A-5-279825

DISCLOSURE OF THE INVENTION

However, in Patent Document 1, only the contents of constituent elements of the Corson alloy are specified. Sufficient strength cannot be obtained only by controlling the contents of constituent elements. In practice, the strength obtained was not sufficient.

In Patent Document 2, focused on the microstructure of the Corson alloy, the size and number of precipitates and inclusions existing in the alloy are specified, but the microstructures are not investigated in more detail and a solution process thereof is not specified. Therefore, sufficient strength cannot be obtained.

In Patent Document 3, the electrical conductivity is low (29 to 33% IACS in embodiments), which is not sufficient. Further, when the content of S is decreased to the specified content, manufacturing cost may increase, and therefore, the resulting alloy is not practical.

It is not possible to obtain sufficient electrical conductivity, strength, and bendability only by the control of the content of Fe under 0.1%, as shown in Patent Document 4.

In Patent Document 5, focused on the microstructures of the Corson alloy, the size and number of inclusions existing in the resulting alloy are specified, but the microstructures are not investigated in more detail and the control of a solution process thereof is not sufficient. Therefore, sufficient strength cannot be obtained.

In Patent Document 6, focused on the microstructures of the Corson alloy, the dispersion state of the precipitate is controlled in a state that an average grain size of nickel silicide ($Ni_2Si$) precipitates is controlled so as to be in the range of 3 to 10 nm while controlling the gap between the grains to be 25 nm or less, the grain size being measured by observing the microstructures thereof using a transmission electron microscope with a magnification of 1,000,000. However, since the contents of Ni and Si are basically too much, electrical conductivity is not sufficiently high.

In Patent Document 7, although the stretching shape of grains of microstructures on the surface of a copper alloy sheet is specified, only the control of the stretching shape of grains does not guarantee a sufficient strength. Further, the control of a solution process thereof is not sufficient. Therefore, electrical conductivity is not sufficiently high.

The present invention has been made to solve the above-mentioned problems, and the object of thereof is to provide a Corson-based copper alloy having high strength, high electrical conductivity, and excellent bendability.

Namely, the present invention relates to the following (1) to (9).

(1) A copper alloy having high strength, high electrical conductivity, and excellent bendability, said copper alloy comprising, in terms of mass %, 0.4 to 4.0% of Ni; 0.05 to 1.0% of Si; and, as an element M, one member selected from 0.005 to 0.5% of P, 0.005 to 1.0% of Cr, and 0.005 to 1.0% of Ti, with the remainder being copper and inevitable impurities, wherein an atom number ratio M/Si of elements M and Si contained in a precipitate having a size of 50 to 200 nm in a microstructure of the copper alloy is from 0.01 to 10 on average, the atom number ratio being measured by a field emission transmission electron microscope with a magnification of 30,000 and an energy dispersive analyzer.

(2) The copper alloy according to (1), wherein the element M is P, wherein a number density of the precipitate having a size of 50 to 200 nm in the microstructure of the copper alloy is from 0.2 to 7.0 per $\mu m^2$ on average, the number density being measured by the field emission transmission electron microscope and the energy dispersive analyzer, wherein an average atom concentration of P contained in the precipitate having said size is from 0.1 to 50 at %, and wherein an average grain size represented by $(\Sigma x)/n$ is 10 μm or less, wherein n represents a number of grains and x represents a size of each of the grains, respectively, according to a measurement by a crystal orientation analysis method using a field emission scanning electron microscope with a backscattered electron diffraction image system mounted thereon.

(3) The copper alloy according to (2), which further comprises, in terms of mass %, one or two or more kinds of Cr, Ti, Fe, Mg, Co, and Zr in a total amount of 0.01 to 3.0%.

(4) The copper alloy according to (1), wherein the element M is Cr, wherein a number density of the precipitate having a size of 50 to 200 nm in the microstructure of the copper alloy is from 0.2 to 20 per $\mu m^2$ on average, the number density being measured by the field emission transmission electron microscope and the energy dispersive analyzer, wherein an average atom concentration of P contained in the precipitate having said size is from 0.1 to 80 at %, and wherein an average grain size represented by $(\Sigma x)/n$ is 30 μm or less, wherein n represents a number of grains and x represents a size of each of the grains, respectively, according to a measurement by a crystal orientation analysis method using a field emission scanning electron microscope and a backscattered electron diffraction image system mounted thereon.

(5) The copper alloy according to (4), which further comprises, in terms of mass %, one or more of Ti, Fe, Mg, Co, and Zr in a total amount of 0.01 to 3.0%.

(6) The copper alloy according to (1), wherein the element M is Ti, wherein a number density of the precipitate having a size of 50 to 200 nm in the microstructure of the copper alloy is from 0.2 to 20 per $\mu m^2$ on average, the number density being measured by the field emission transmission electron microscope and the energy dispersive analyzer, wherein an average atom concentration of P contained in the precipitate having said size is from 0.1 to 50 at %, and wherein an average grain size represented by $(\Sigma x)/n$ is 20 μm or less, wherein n represents a number of grains and x represents a size of each of the grains, respectively, according to a measurement by a crystal orientation analysis method using a field emission scanning electron microscope and a backscattered electron diffraction image system mounted thereon.

(7) The copper alloy according to (6), which further comprises, in terms of mass %, one or two or more kinds of Fe, Mg, Co, and Zr in a total amount of 0.01 to 3.0%.

(8) The copper alloy according to any one of (1) to (7), which further comprises, in terms of mass %, 0.005 to 3.0% of Zn.

(9) The copper alloy according to any one of (1) to (8), which further comprises, in terms of mass %, 0.01 to 5.0% of Sn.

According to a first aspect of the invention, in a microstructure of the Corson-based copper alloy, the average grain size is refined up to 10 μm or less to thereby improve the bendability of the copper alloy. Additionally, the grain refining in the microstructure is achieved by a pinning effect of restraining a grain growth of a P-containing precipitate (hereinafter, it may be also referred as a phosphide and a phosphor compound) such as Ni—Si—P, Fe—P, Fe—Ni—P, and Ni—Si—Fe—P.

The inventors found that the pinning effect of restraining the grain growth of the P-containing precipitate is much larger than that of an ordinary $Ni_2Si$-based precipitate in which P is not contained. At the same time, the inventors found that the magnitude of the pinning effect is dependent on the P content (atom concentration) in the P-containing precipitate.

In other words, it is considered that the reason that it has been substantially difficult to refine the average grain size to 10 μm or less in the microstructure of the conventional Corson-based copper alloy is that the ordinary $Ni_2Si$-based precipitate without P cannot exhibit sufficient pinning effect.

In this case, even when P is contained as one of alloy contents, all of the precipitates present in the microstructure of the copper alloy may not be the P-containing precipitate. That is, in an actual microstructure of the copper alloy, $Ni_2Si$-based precipitate without P is present together with the P-containing precipitate. In other words, P-containing precipitate having a large pinning effect of restraining the grain growth is present together with $Ni_2Si$-based precipitate without P that has a small pinning effect of restraining the grain growth.

For this reason, the pinning effect of restraining an actual grain growth is dependent on the amount of the P-containing precipitate in the microstructure of the copper alloy. In other words, in order to allow the average grain size of the microstructure of the copper alloy to be 10 μm or less, it is necessary that a certain amount or more of the P-containing precipitate is present in the microstructure of the copper alloy.

In this regard, in the invention, the amount of the P-containing precipitate present in the microstructure of the copper alloy is not directly specified, but the amount of the P-containing precipitate is controlled on the basis of the atom concentration of P contained in all of the precipitates having the specific size (50 to 200 nm) present in the microstructure of the copper alloy. This is because of ineffectiveness and inaccuracy of a measurement in the case where only the P-containing precipitate is picked up among the P-containing precipitate and the precipitate without P present in the microstructure of the copper alloy for the purpose of an analysis and a measurement.

Therefore, in the invention, the atom concentration of P is measured for all of the precipitates (all of the precipitates regardless of containing P) having the specific size, and the amount of the P-containing precipitate in the microstructure of the copper alloy is controlled on the basis of the average atom concentration of P contained in the precipitate. Further, as a precondition of the invention, the number density of all of the precipitates (chemical compound) having the specific size is guaranteed (specified).

With such a configuration, in the invention, the pinning effect of largely restraining the grain growth is exhibited, and the average grain size in the microstructure of the Corson-based copper alloy is refined to 10 μm or less, whereby bendability of the copper alloy is improved.

The guarantee of the number density of the precipitate (chemical compound) having the specific size and the control of the average atom concentration of P contained in the precipitate may be enabled by the preconditions such that the amounts of P and the like are controlled in the specific range of the invention and the raising temperature speed at the time of the solution treatment and the cooling speed after the solution treatment are controlled. Additionally, without the control of the average atom concentration of P contained in the precipitate (control of the amount of the P-containing precipitate), it is difficult to refine the average grain size in the microstructure of the Corson-based copper alloy to be 10 μm or less.

Moreover, in the invention, in order to maintain high electrical conductivity, the contents of Ni and Si as basic alloy contents are controlled to be relatively small. Additionally, the P-containing precipitate as well as the other precipitates including the $Ni_2Si$ are allowed to be finely precipitated so as to improve strength, and contents of Ni and Si are controlled to be relatively small so as to obtain high strength.

According to a second aspect of the invention, the Cr-containing precipitate contained in the microstructure of the Corson-based copper alloy is not completely contained in a solid solution state even when the solution treatment temperature is high and remained in a form of the precipitate in the microstructure, and thus exhibits the pinning effect of restraining the grain growth.

That is, when Cr is contained, the Cr-containing precipitate (Cr compound) such as Ni—Si—Cr and Si—Cr is formed in the microstructure of the Corson-based copper alloy. The Cr-containing precipitate is not completely contained in a sold solution state even when the solution treatment temperature is, for example, 900° C., remains in a form of the precipitate in the microstructure, and has a specific property of exhibiting the pinning effect of restraining the grain growth. Moreover, the Cr-containing precipitate of the invention has the pinning effect of restraining the grain growth that is outstandingly larger than that of an ordinary (general) $Ni_2Si$-based precipitate in which Cr or the Cr-containing precipitate is not contained.

As a matter of fact, due to the high solution treatment temperature, the Cr-containing precipitate is contained in a solid solution state to a certain degree and the grain growth is unavoidable. However, relative to the ordinary (general) $Ni_2Si$-based precipitate in which Cr and the Cr-containing precipitate are not contained, the degree of the grain growth is largely suppressed up to the degree that the average grain size is 30 μm or less. For this reason, the solution treatment temperature may be increased up to a high temperature, so that amounts of solid solution of Ni and Si may be increased up to a large extent, and amounts of fine Ni—Si precipitate may be increased up to a large extent during an age hardening process in a rear stage. As a result, without decreasing bendability and the like due to an increase of an average grain size, it is possible to obtain the copper alloy having higher strength.

The magnitude of the pinning effect of the Cr-containing precipitate is largely dependent on the Cr content (atom concentration) in the Cr-containing precipitate. In other words, it is considered that the reason that it has been substantially difficult to refine the average grain size in the microstructure of the conventional Corson-based copper alloy is that the ordinary $Ni_2Si$-based precipitate without Cr cannot exhibit sufficient pinning effect.

In this case, even when Cr is contained as one of alloy contents, all of the precipitate present in the microstructure of the copper alloy may not be the Cr-containing precipitate. That is, in an actual microstructure of the copper alloy, $Ni_2Si$-based precipitate without Cr is present together with the Cr-containing precipitate. In other words, Cr-containing precipitate having a large pinning effect of restraining the grain growth is present together with $Ni_2Si$-based precipitate without Cr that has a small pinning effect of restraining the grain growth.

For this reason, the pinning effect of restraining an actual grain growth is dependent on the amount of the Cr-containing precipitate in the microstructure of the copper alloy. In other words, in order to refine the average grain size of the microstructure of the copper alloy to be 30 μm or less, it is necessary that a certain amount or more of the Cr-containing precipitate is present in the microstructure of the copper alloy.

In this regard, in the invention, the amount of the Cr-containing precipitate present in the microstructure of the copper alloy is not directly specified, but the amount of the Cr-containing precipitate is controlled on the basis of the atom concentration of Cr contained in all of the precipitates having the specific size (50 to 200 nm) present in the microstructure of the copper alloy. This is because of ineffectiveness and inaccuracy of a measurement in the case where only the Cr-containing precipitate is picked up among the Cr-containing precipitate and the precipitate without Cr present in the microstructure of the copper alloy for the purpose of an analysis and a measurement.

Therefore, in the invention, the atom concentration of Cr is measured for all of the precipitates (all of the precipitates regardless of containing Cr) having the specific size, and the amount of the Cr-containing precipitate in the microstructure of the copper alloy is controlled on the basis of the average atom concentration of Cr contained in the precipitate. Further, as a precondition of the invention, the number density of all of the precipitates (chemical compound) having the specific size is guaranteed (specified).

With such a configuration, in the invention, the pinning effect of largely restraining the grain growth is exhibited, and the average grain size in the microstructure of the Corson-based copper alloy is refined to be 30 μm or less, whereby bendability of the copper alloy is improved.

The guarantee of the number density of the precipitate (chemical compound) having the specific size and the control of the average atom concentration of Cr contained in the precipitate may be enabled by the preconditions such that the amounts of Cr and the like are controlled in the specific range of the invention and the raising temperature speed at the time of the solution treatment and the cooling speed after the solution treatment are controlled. Additionally, without the control of the average atom concentration of Cr contained in the precipitate (control of the amount of the Cr-containing precipitate), it is difficult to refine the average grain size in the microstructure of the Corson-based copper alloy to be 30 μm or less, and particularly 10 μm or less.

Moreover, in the invention, in order to maintain high electrical conductivity, the contents of Ni and Si as basic alloy contents are controlled to be relatively small. Additionally, the Cr-containing precipitate as well as the other precipitates including $Ni_2Si$ are allowed to be finely precipitated so as to improve strength and the contents of Ni and Si are controlled to be relatively small so as to obtain high strength.

According to a third aspect of the invention, a Ti-containing precipitate contained in the microstructure of the Corson-based copper alloy is not completely contained in a solid solution state even when the solution treatment temperature is high and remained in a form of the precipitate in the microstructure, and thus exhibits the pinning effect of restraining the grain growth.

That is, when Ti is contained, the Ti-containing precipitate (Ti compound) such as Ni—Si—Ti is formed in the microstructure of the Corson-based copper alloy. The Ti-containing precipitate is not completely contained in a sold solution state even when the solution treatment temperature is, for example, 900° C., remains in a form of the precipitate in the microstructure, and has a specific property of exhibiting the pinning effect of restraining the grain growth. Moreover, the Ti-containing precipitate of the invention has the pinning effect of restraining the grain growth that is outstandingly larger than that of an ordinary (general) $Ni_2Si$-based precipitate in which Ti and the Ti-containing precipitate are not contained.

As a matter of fact, due to the high solution treatment temperature, the Ti-containing precipitate is contained in a solid solution state to a certain degree and the grain growth is unavoidable. However, relative to the ordinary (general) $Ni_2Si$-based precipitate in which Ti and the Ti-containing precipitate are not contained, the degree of the grain growth is largely suppressed up to the degree that the average grain size is 20 μm or less. For this reason, the solution treatment temperature may be increased up to a high temperature, so that amounts of solid solution of Ni and Si may be increased up to a large extent, and amounts of fine Ni—Si precipitate may be increased up to a large extent during an age hardening process in a rear stage. As a result, without decreasing bendability and the like due to an increase of an average grain size, it is possible to obtain the copper alloy having higher strength.

The magnitude of the pinning effect of the Ti-containing precipitate is largely dependent on the Ti content (atom concentration) in the Ti-containing precipitate. In other words, it is considered that the reason that it has been substantially difficult to refine the average grain size in the microstructure of the conventional Corson-based copper alloy is that the ordinary $Ni_2Si$-based precipitate without Ti cannot exhibit sufficient pinning effect.

In this case, even when Ti is contained as one of alloy content, all of the precipitates present in the microstructure of the copper alloy may not be the Ti-containing precipitate. That is, in an actual microstructure of the copper alloy, $Ni_2Si$-based precipitate without Ti is present together with the Ti-containing precipitate. In other words, Ti-containing precipitate having a large pinning effect of restraining the grain growth is present together with $Ni_2Si$-based precipitate without Ti that has a small pinning effect of restraining the grain growth.

For this reason, the pinning effect of restraining an actual grain growth is dependent on the amount of the Ti-containing precipitate in the microstructure of the copper alloy. In other words, in order to refine the average grain size of the microstructure of the copper alloy to be 20 μm or less, it is necessary that a certain amount or more of the Ti-containing precipitate is present in the microstructure of the copper alloy.

In this regard, in the invention, the amount of the Ti-containing precipitate present in the microstructure of the copper alloy is not directly specified, but the amount of the Ti-containing precipitate is controlled on the basis of the atom concentration of Ti contained in all of the precipitates having the specific size (50 to 200 nm) present in the microstructure of the copper alloy. This is because of ineffectiveness and inaccuracy of a measurement in the case where only the Ti-containing precipitate is picked up among the Ti-containing precipitate and the precipitate without Ti present in the microstructure of the copper alloy for the purpose of an analysis and a measurement.

Therefore, in the invention, the atom concentration of Ti is measured for all of the precipitates (all of the precipitates regardless of containing Ti) having the specific size, and the amount of the Ti-containing precipitate in the microstructure of the copper alloy is controlled on the basis of the average atom concentration of Ti contained in the precipitate. Further, as a precondition of the invention, the number density of all of the precipitates (chemical compound) having the specific size is guaranteed (specified).

With such a configuration, in the invention, the pinning effect of largely restraining the grain growth is exhibited, and the average grain size in the microstructure of the Corson-based copper alloy is refined to be 20 μm or less, whereby bendability of the copper alloy is improved.

The guarantee of the number density of the precipitate (chemical compound) having the specific size and the control of the average atom concentration of Ti contained in the precipitate may be enabled by the preconditions such that the amounts of Ti and the like are controlled in the specific range of the invention and the raising temperature speed at the time of the solution treatment and the cooling speed after the solution treatment are controlled. Additionally, without the control of the average atom concentration of Ti contained in the precipitate (controlling the amount of the Ti-containing precipitate), it is difficult to refine the average grain size in the microstructure of the Corson-based copper alloy to be 20 μm or less, and particularly 10 μm or less.

Moreover, in the invention, in order to maintain high electrical conductivity, the contents of Ni and Si as basic alloy contents are controlled to be relatively small. Additionally, the Ti-containing precipitate and the other precipitates including $Ni_2Si$ are allowed to be finely precipitated so as to improve strength and the contents of Ni and Si are controlled to be relatively small so as to obtain high strength.

Accordingly, the present invention provides a copper alloy having high strength, high electrical conductivity, and excellent bendability in a balanced manner.

BEST MODE FOR CARRYING OUT THE INVENTION

Figure 1:
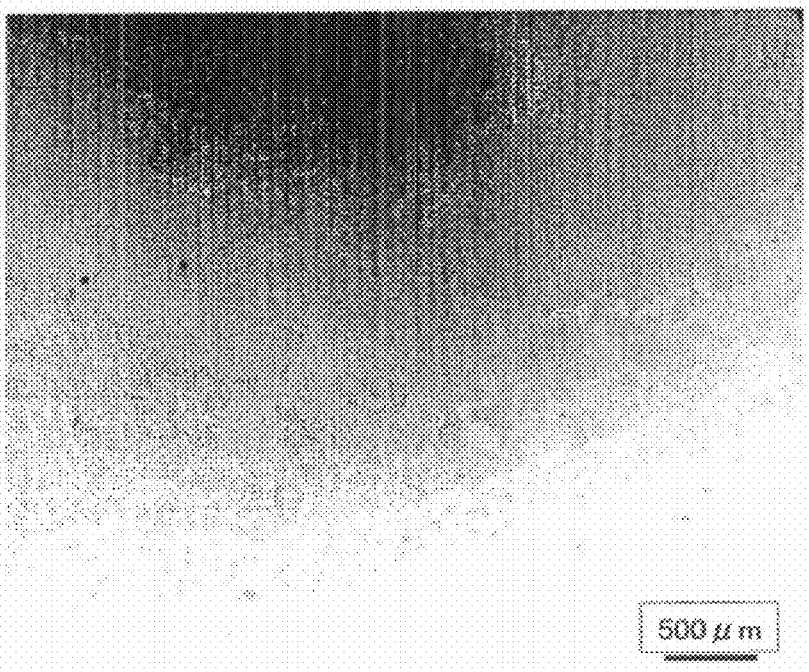
FIG. 1 is a drawing-substituting TEM photograph of a microstructure of a copper alloy sheet according to the invention.

The present invention provides a copper alloy having high strength, high electrical conductivity, and excellent bendability, the copper alloy containing, in terms of mass %, 0.4 to 4.0% of Ni; 0.05 to 1.0% of Si; and, as an element M, one member selected from 0.005 to 0.5% of P, 0.005 to 1.0% of Cr, and 0.005 to 1.0% of Ti, with the remainder being copper and inevitable impurities, in which an atom number ratio M/Si of elements M and Si contained in a precipitate having a size of 50 to 200 nm in a microstructure of the copper alloy is from 0.01 to 10 on average, the atom number ratio being measured by a field emission transmission electron microscope with a magnification of 30,000 and an energy dispersive analyzer. Hereinafter, in this specification, M is referred to as one element selected from P, Cr and Ti.

(Atom Number Ratio of M and Si Contained in Precipitate)

In the invention, in order to ensure a fine grain size of a copper alloy, it is preferable that an atom number ratio M/Si of elements M and Si contained in the precipitate having a size of 50 to 200 nm in a microstructure of the copper alloy is in the range of 0.01 to 10 on average, according to a measurement by a field emission transmission electron microscope with a magnification of 30,000 and an energy dispersive analyzer.

When the atom number ratio M/Si of M and Si contained in the precipitate is less than 0.01 on average, a grain becomes large and a decrease possibility of bendability increases. On the other hand, when the atom number ratio M/Si of M and Si contained in the precipitate is more than 10 on average, an amount of Si in a solid solution state is too large, and a there is high possibility that electrical conductivity decreases. Therefore, it is preferable that the atom number ratio M/Si of M and Si contained in the precipitate is in the range of 0.01 to 10, and more preferably in the range of 0.10 to 5.0.

Hereinafter, desirable aspects of the invention will be described in detail.

First, as one of desirable aspects of the invention, a first aspect of the invention will be described.

(Element Composition of Copper Alloy)

First, a chemical element composition of a Corson-based alloy in accordance with the first aspect of the invention will be described, in which the alloy meets required strength and electrical conductivity as well as excellent bendability and stress relaxation resistance that are necessary for the above-mentioned purposes.

In the first aspect of the invention, in order to achieve high strength, high electrical conductivity, and excellent bendability, the basic composition thereof is constituted of a copper alloy containing, in terms of mass %, 0.4 to 4.0% of Ni, 0.05 to 1.0% of Si, and 0.005 to 0.5% of P, respectively, with the remainder being copper and inevitable impurities. The composition is a critical precondition of the element composition in order to enable a grain of a microstructure of the copper alloy to be refined and to control an average atom concentration of P contained in the precipitate ($Ni_2Si$). Hereinafter, % will indicate mass % to explain respective elements.

In addition to the basic composition, one or two of more kinds of Cr, Ti, Fe, Mg, Co, and Zr may be contained in a total amount of 0.01 to 3.0%. Additionally, 0.005 to 3.0% of Zn may be contained. Further, 0.01 to 5.0% of Sn may be contained.

0.4 to 4.0% of Ni

Since Ni crystallizes or precipitates a chemical compound ($Ni_2Si$ or the like) with Si, Ni ensures strength and electrical conductivity of the copper alloy. Additionally, Ni forms a chemical compound with P. When the Ni content is as little as less than 0.4%, a production of a precipitate is insufficient, and thus desired strength is not obtained and a grain of a microstructure of the copper alloy becomes large. Further, a ratio of a precipitate which easily segregates becomes large and non-uniformity of a final product increases. On the other hand, when the Ni content is as much as more than 4.0%, precipitate number density increases as well as electrical conductivity decreases, and thus bendability decreases. Therefore, the amount of Ni is specified to be in the range of 0.4 to 4.0%.

0.05 to 1.0% of Si

Since Si crystallizes or precipitates a chemical compound ($Ni_2Si$) with Ni, Si enables strength and electrical conductivity of the copper alloy to be improved. Additionally, Si forms a chemical compound with P. When the Si content is as little as less than 0.05%, a production of a precipitate is insufficient, and thus desired strength is not obtained and a grain of a microstructure of the copper alloy becomes large. Further, a ratio of a precipitate which easily segregates becomes large and non-uniformity of a final product increases. On the other hand, when the Si content is as much as more than 1.0%, the number of the precipitates becomes too large, bendability decreases as well as an atom number ratio P/Si of P and Si contained in the precipitate decreases. Therefore, the amount of Si is specified to be in the range of 0.05 to 1.0%.

0.005 to 0.5% of P

P is a critical element for forming a P-containing precipitate and for controlling an atom concentration of P in a P-containing precipitate in the above-mentioned specific range. By forming the P-containing precipitate (phosphide, phosphor compound), strength and electrical conductivity are improved, a grain becomes fine because of forming the phosphide, and thus bendability is improved. Herein, among the effects, especially the effect of improving bendability is exhibited by controlling the atom concentration of P of the P-containing precipitate within the above-mentioned specific range.

When the P content is as little as less than 0.005%, the function and the effect are not effectively exhibited. Meanwhile, when the P content is as much as more than 0.5%, the precipitate becomes large, and bendability decreases as well as an atom concentration of P contained in the precipitate becomes too high. Therefore, the P content is specified to be in the range of 0.005 to 0.5%.

In this case, the P-containing precipitate mentioned in the invention represents the P-containing precipitate of Ni—Si—P in the basic composition of Ni—Si—P. When Fe, Mg, and the like are contained therein, the P-containing precipitate of (Fe, Mg)-P, (Fe, Mg)—Ni—P, Ni—Si—(Fe, Mg)-P or the like are formed in addition to or in place of the P-containing precipitate of Ni—Si—P. Additionally, when Cr, Ti, Co, Zr and the like are contained therein, the P-containing precipitate is formed in such a manner that some or all of Fe, Mg and the like are substituted.

Cr, Ti, Fe, Mg, Co, and Zr in a Total Amount of 0.01 to 3.0%

Since these elements form the phosphide as described above, strength and electrical conductivity are improved as well as a grain refining is effective. In the case where the effect is exhibited, one or two or more kinds of Cr, Ti, Fe, Mg, Co, and Zr is selectively contained to the extent of 0.01% or more in total. However, when the total content (total amount) of these elements exceeds 3.0%, the precipitate becomes large, and bendability decreases as well as an atom concentration of P contained in the precipitate becomes too high. Therefore, the total content (total amount) of Cr, Ti, Fe, Mg, Co, and Zr is specified to be in the range of 0.01 to 3.0% in the case where one or more of the elements are selectively contained.

0.005 to 3.0% of Zn

Zn is an element which improves thermal ablation resistance of Sn plating or a soldering used for bonding electronic components and is effective for restraining a thermal ablation. In the case where the effect is effectively exhibited, Zn is selectively contained in an amount of 0.005% or more. However, when Zn is contained as much as more than 3.0%, the wettability and spreadability of molten Sn or solder are deteriorated. Additionally, when the content increases, electrical conductivity is greatly decreased. Therefore, Zn needs to be selectively contained in consideration of the effect of improving thermal ablation resistance and a reaction of decreasing electrical conductivity. In that case, Zn content is specified to be in the range of 0.005 to 3.0%, and more preferably in the range of 0.005 to 1.5%.

0.01 to 5.0% of Sn

Sn is contained in the copper alloy in a solid solution state and contributes for improving strength. In the case where the effect is effectively exhibited, Sn is selectively contained in an amount of 0.01% or more. However, when Zn is contained as much as more than 5.0%, the effect is saturated. Additionally, when the content increases, electrical conductivity is greatly decreased. Therefore, Sn needs to be selectively contained in consideration of the effect of improving strength and a reaction of decreasing electrical conductivity. In that case, Sn content is specified to be in the range of 0.01 to 5.0%, and more preferably in the range of 0.01 to 1.0%.

Content of Other Elements

The other elements are basically impurities and the contents thereof are preferably as low as possible. For example, the elements of the impurities such as Al, Be, V, Nb, Mo, and W easily form a large precipitate, and thus bendability is deteriorated as well as electrical conductivity is easily decreased. Therefore, it is preferable that the total content of these elements is as low as possible and 0.5% or less. Besides, the elements such as B, C, Na, S, Ca, As, Se, Cd, In, Sb, Bi, and MM (Mischmetal) which are contained in the copper alloy in a small amount easily cause a decrease of electrical conductivity. Thus, it is preferable that the total content of these elements is as low as possible and 0.1% or less. However, in order to decrease the amounts of the elements, a base metal is used or a refining is performed, which increase a manufacturing cost. Therefore, in order to decrease the manufacturing cost, these elements may be contained within the upper limit of the above-mentioned range.

(Microstructure of Copper Alloy)

In the invention, in the state where the above-mentioned Cu—Ni—Si—P-based alloy composition is preconditioned, the microstructure of the copper alloy is designed, and the average grain size is decreased as fine as 10 μm or less, thereby improving bendability of the copper alloy.

Further, the design of the microstructure is achieved by controlling the average atom concentration of P contained in the precipitate present in the microstructure of the copper alloy (controlling an amount of the P-containing precipitate). When the design of the microstructure is not achieved by the control of the average atom concentration of P contained in the precipitate, it is not possible to ensure an adequate amount of the P-containing precipitate that has a large pinning effect of restraining a grain growth in the microstructure of the copper alloy. As a result, in such a case, it is difficult to refine the average grain size in the microstructure of the copper alloy to be 10 μm or less.

(Number Density of Precipitate)

However, as a precondition, it is necessary that the number density of the precipitate present in the microstructure of the copper alloy is guaranteed. When the number density of the precipitate present in the microstructure of the copper alloy is too small or too large, the effect of improving bendability is not sufficiently exhibited even if the average atom concentration of P or the average atom concentration of P and Si contained in the precipitate is controlled. Therefore, in the invention, in order to guarantee the grain size refining effect due to the precipitate, the number density of a precipitate having a specific size is specified to be in a specific range.

That is, the number density of the precipitate having a size of 50 to 200 nm in the microstructure of the copper alloy, which is measured by the field emission transmission electron microscope and the energy dispersive analyzer, is specified to be in the range of 0.2 to 7.0 per $\mu m^2$. The precipitate having the specific size has a selection standard caring about only the size (maximum diameter) of the precipitate regardless of containing P.

When the number density of the precipitate is less than 0.2 per $\mu m^2$, the number of precipitate is too small. Accordingly, the grain size refining effect is not sufficiently exhibited even when the average atom concentration of P or P and Si contained in the precipitate is controlled, and thus the grain becomes large and bendability may be decreased.

On the other hand, when the number density of the precipitate is more than 7.0 per $\mu m^2$, the number of precipitate is too large and a formation of a shear band is promoted at the time of bending process, and thus bendability is decreased. Therefore, the number density of the precipitate having a size of 50 to 200 nm is specified to be in the range of 0.2 to 7.0 per $\mu m^2$, and more preferably in the range of 0.5 to 5.0 per $\mu m^2$.

(Average Atom Concentration of P Contained in Precipitate)

In a state that the number density of the precipitate is guaranteed, in the invention, in order to refine the average grain size in the microstructure of the copper alloy so as to be 10 μm or less, the average atom concentration of P contained in the precipitate in the microstructure of the copper alloy such as NiSi, which has a size of 50 to 200 nm, is controlled to be in the range of 0.1 to 50 at %, in which the average atom concentration is measured using the field emission transmission electron microscope with a magnification of 30,000 and the energy dispersive analyzer.

As described above, in the invention, the amount of the P-containing precipitate present in the microstructure of the copper alloy is not directly specified, but is controlled on the basis of the average atom concentration of P in the precipitate having the specific size (50 to 200 nm) present in the microstructure of the copper alloy. Therefore, in the invention, the atom concentration of P is measured for all of the precipitates (precipitate regardless of containing P) having the specific size, and the amount of the P-containing precipitate in the microstructure of the copper alloy is controlled on the basis of the average atom concentration of P in the precipitate.

When the average atom concentration of P contained in all the precipitates is as little as less than 0.1 at %, the grain of the microstructure of the copper alloy becomes large and bendability decreases. On the other hand, when the average atom concentration of P contained in the precipitates is as much as more than 50 at %, elements in a solid solution state other than P increase in the microstructure of the copper alloy, and thus electrical conductivity is decreased. Therefore, the average atom concentration of P contained in the precipitate is specified to be in the range of 0.1 to 50 at %, and preferably in the range of 0.5 to 40 at %.

(Average Grain Size)

In the invention, the grain size of the microstructure of the copper alloy refined by the control of the precipitate of the microstructure of the copper alloy is taken as a standard for substantially improving bendability, and the average grain size of the microstructure of the copper alloy is specified. That is, when the number of grains and a grain size of each of the grains are referred to as n and X, respectively, according to a measurement by a crystal orientation analysis method using a field emission scanning electron microscope with a magnification of 350 and a backscattered electron diffraction image system mounted thereon, an average grain size represented by $(\Sigma x)/n$ is specified to be 10 μm or less.

When the average grain size is as large as more than 10 μm, desired bendability in the invention cannot be obtained. Therefore, the average grain size is specified to be 10 μm or less, and more preferably 7 μm or less.

Subsequently, as one of desirable aspects of the invention, a second aspect of the invention will be described.

(Element Composition of Copper Alloy)

First, a chemical element composition of a Corson-based alloy in accordance with the second aspect of the invention will be described, in which the alloy meets required strength and electrical conductivity as well as excellent bendability and stress relaxation resistance that are necessary for the above-mentioned purposes.

In the second aspect of the invention, in order to achieve high strength, high electrical conductivity, and excellent bendability, the basic composition thereof is constituted of a copper alloy containing, in terms of mass %, 0.4 to 4.0% of Ni, 0.05 to 1.0% of Si, and 0.005 to 1.0% of Cr, respectively, with the remainder being copper and inevitable impurities. The composition is a critical precondition of the element composition in order to enable a grain of a microstructure of the copper alloy to be refined and to control an average atom concentration of Cr contained in the precipitate ($Ni_2Si$). Hereinafter, % will indicate mass % to explain respective elements.

In addition to the basic composition, 0.005 to 3.0% of Zn may be contained. Additionally, 0.01 to 5.0% of Sn may be contained. Further, one or two or more kinds of Ti, Fe, Mg, Co, and Zr may be contained in a total amount of 0.01 to 3.0%.

0.4 to 4.0% of Ni

Since Ni crystallizes or precipitates a chemical compound ($Ni_2Si$ or the like) with Si, Ni ensures strength and electrical conductivity of the copper alloy. Additionally, Ni forms a chemical compound with Cr. When the Ni content is as little as less than 0.4%, a production of a precipitate is insufficient, and thus desired strength is not obtained and a grain of a microstructure of the copper alloy becomes large. Further, a ratio of a precipitate which easily segregates becomes large and non-uniformity of a final product increases. On the other hand, when the Ni content is as much as more than 4.0%, precipitate number density increases as well as electrical conductivity decreases, and thus bendability decreases. Therefore, the amount of Ni is specified to be in the range of 0.4 to 4.0%.

0.05 to 1.0% of Si

Since Si crystallizes or precipitates a chemical compound ($Ni_2Si$) with Ni, Si enables strength and electrical conductivity of the copper alloy to be improved. Additionally, Si forms a chemical compound with Cr. When the Si content is as little as less than 0.05%, a production of a precipitate is insufficient, and thus desired strength is not obtained and a grain of a microstructure of the copper alloy becomes large. Further, a ratio of a precipitate which easily segregates becomes large and non-uniformity of a final product increases. On the other hand, when the Si content is as much as more than 1.0%, the number of the precipitates becomes too large, bendability decreases as well as an atom number ratio Cr/Si of Cr and Si contained in the precipitate decreases. Therefore, the amount of Si is specified to be in the range of 0.05 to 1.0%.

0.005 to 1.0% of Cr

Cr is a critical element for forming a Cr-containing precipitate and for controlling an atom concentration of Cr in a Cr-containing precipitate in the above-mentioned specific range. By forming the Cr-containing precipitate, strength and electrical conductivity are improved, a grain becomes fine because of forming the Cr-containing precipitate, and thus bendability is improved. Herein, among the effects, especially the effect of improving bendability is exhibited by controlling the atom concentration of Cr of the Cr-containing precipitate within the above-mentioned specific range.

When the Cr content is as little as less than 0.005%, the function and the effect are not effectively exhibited. Meanwhile, when the Cr content is as much as more than 1.0% and more severely more than 0.6%, the precipitate becomes large, and bendability decreases as well as an atom concentration of Cr contained in the precipitate becomes too high. Therefore, the Cr content is specified to be in the range of 0.005 to 1.0%, more preferably 0.005 to 0.6%.

In this case, the Cr-containing precipitate mentioned in the invention represents the Cr-containing precipitate of Ni—Si—Cr in the basic composition of Ni—Si—Cr. When Fe, Mg, and the like are contained therein, the Cr-containing precipitate of (Fe, Mg)—Si—Cr, Ni—Si—(Fe, Mg)—Cr and the like are formed in addition to or in place of the Cr-containing precipitate such as Ni—Si—Cr. Additionally, when Ti, Co, Zr and the like are contained therein, the Cr-containing precipitate is formed in such a manner that some or all of Fe, Mg and the like are substituted.

Ti, Fe, Mg, Co, and Zr in a Total Amount of 0.01 to 3.0%

Since these elements form the Cr-containing precipitate as described above, strength and electrical conductivity are improved as well as a grain refining is effective. In the case where the effect is exhibited, one or two or more kinds of Ti, Fe, Mg, Co, and Zr is selectively contained to the extent of 0.01% or more in total. However, when the total content (total amount) of these elements exceeds 3.0%, the precipitate becomes large, and bendability decreases as well as an atom concentration of Cr contained in the precipitate becomes too high. Therefore, the total content (total amount) of Ti, Fe, Mg, Co, and Zr is specified to be in the range of 0.01 to 3.0% in the case where one or more of the elements are selectively contained.

0.005 to 3.0% of Zn

Zn is an element which improves thermal ablation resistance of Sn plating or a soldering used for bonding electronic components and is effective for restraining a thermal ablation. In the case where the effect is effectively exhibited, Zn is selectively contained in an amount of 0.005% or more. However, when Zn is contained as much as more than 3.0%, the wettability and spreadability of molten Sn or solder are deteriorated. Additionally, when the content increases, electrical conductivity is greatly decreased. Therefore, Zn needs to be selectively contained in consideration of the effect of improving thermal ablation resistance and a reaction of decreasing electrical conductivity. In that case, Zn content is specified to be in the range of 0.005 to 3.0%, and more preferably in the range of 0.005 to 1.5%.

0.01 to 5.0% of Sn

Sn is contained in the copper alloy in a solid solution state and contributes for improving strength. In the case where the effect is effectively exhibited, Sn is selectively contained in an amount of 0.01% or more. However, when Zn is contained as much as more than 5.0%, the effect is saturated. Additionally, when the content increases, electrical conductivity is greatly decreased. Therefore, Sn needs to be selectively contained in consideration of the effect of improving strength and a reaction of decreasing electrical conductivity. In that case, Sn content is specified to be in the range of 0.01 to 5.0%, and more preferably in the range of 0.01 to 1.0%.

Content of Other Elements

The other elements are basically impurities and the contents thereof are preferably as low as possible. For example, the elements of the impurities such as Mn, Ca, Ag, Cd, Be, Au, Pt, S, Pb, and P easily form a large precipitate, and thus bendability is deteriorated as well as electrical conductivity is easily decreased. Therefore, it is preferable that the total content of these elements is as low as possible and 0.5% or less. Besides, the elements such as Hf, Th, Li, Na, K, Sr, Pd, W, Nb, Al, V, Y, Mo, In, Ga, Ge, As, Sb, Bi, Te, B, C and Mischmetal which are contained in the copper alloy in a small amount easily cause a decrease of electrical conductivity. Thus, it is preferable that the total content of these elements is as low as possible and 0.1% or less. However, in order to decrease the amounts of the elements, a base metal is used or a refining is performed, which increase a manufacturing cost. Therefore, in order to decrease the manufacturing cost, these elements may be contained within the upper limit of the above-mentioned range.

(Microstructure of Copper Alloy)

In the invention, in the state where the above-mentioned Cu—Ni—Si—Cr-based alloy composition is preconditioned, the microstructure of the copper alloy is designed, and the average grain size is decreased as fine as 30 μm or less, and more preferably 10 μm or less, thereby improving bendability of the copper alloy. In the invention, the design of the microstructure is achieved by controlling an amount of the Cr-containing precipitate. More specifically, the design of the microstructure is achieved by a control that a certain amount of the number density of the precipitate having a certain size is ensured in the microstructure of the copper alloy and a certain degree of the average atom concentration of Cr contained in the precipitate having the certain size is ensured.

When the design of the microstructure is not achieved by the above-mentioned control, it is not possible to ensure an adequate amount of the Cr-containing precipitate that has a large pinning effect of restraining a grain growth in the microstructure of the copper alloy. As a result, in such a case, it is difficult to refine the average grain size of the microstructure of the copper alloy to be 30 μm or less, and more preferably 10 μm or less. As described above, the Cr-containing precipitate of the invention is not completely contained in a sold solution state even when the solution treatment temperature is high, remains in a form of the precipitate in the microstructure, and exerts the pinning effect of greatly restraining the grain growth. However, as described above, the degree of the pinning effect of the Cr-containing precipitate is largely dependent on the average atom concentration of Cr contained in the precipitate having a size of 50 to 200 nm and the number density of the precipitate having a size of 50 to 200 nm.

(Number Density of Precipitate)

However, as a precondition, it is necessary that the number density of the precipitate present in the microstructure of the copper alloy is guaranteed. When the number density of the precipitate present in the microstructure of the copper alloy is too small or too large, the effect of improving bendability is not sufficiently exhibited even if the average atom concentration of Cr or the average atom concentration of Cr and Si contained in the precipitate is controlled. Therefore, in the invention, in order to guarantee the grain size refining effect due to the precipitate, the number density of a precipitate having a specific size is specified to be in a specific range.

That is, the number density of the precipitate having a size of 50 to 200 nm in the microstructure of the copper alloy, which is measured by the field emission transmission electron microscope and the energy dispersive analyzer, is specified to be in the range of 0.2 to 20 per $\mu m^2$. The precipitate having the specific size has a selection standard caring about only the size (maximum diameter) of the precipitate regardless of containing Cr.

When the number density of the precipitate is less than 0.2 per $\mu m^2$, the number of precipitate is too small. Accordingly, the grain size refining effect is not sufficiently exhibited even when the average atom concentration of Cr or Cr and Si contained in the precipitate is controlled, and thus the grain becomes large and bendability may be decreased.

On the other hand, when the number density of the precipitate is more than 20 per $\mu m^2$, the number of precipitate is too large and a formation of a shear band is promoted at the time of bending process, and thus bendability is decreased. Therefore, the number density of the precipitate having a size of 50 to 200 nm is specified to be in the range of 0.2 to 20 per $\mu m^2$, and more preferably in the range of 0.5 to 15 per $\mu m^2$.

(Average Atom Concentration of Cr Contained in Precipitate)

In a state that the number density of the precipitate is guaranteed, in the invention, in order to refine the average grain size in the microstructure of the copper alloy so as to be 30 μm or less, the average atom concentration of Cr contained in the precipitate in the microstructure of the copper alloy such as Ni—Si—Cr, which has a size of 50 to 200 nm, is controlled to be in the range of 0.1 to 80 at %, in which the average atom concentration is measured using the field emission transmission electron microscope with a magnification of 30,000 and the energy dispersive analyzer.

As described above, in the invention, the amount of the Cr-containing precipitate present in the microstructure of the copper alloy is not directly specified, but is controlled on the basis of the average atom concentration of Cr in the precipitate having the specific size (50 to 200 nm) present in the microstructure of the copper alloy. Therefore, in the invention, the atom concentration of Cr is measured for all of the precipitates (precipitate regardless of containing Cr) having the specific size, and the amount of the Cr-containing precipitate in the microstructure of the copper alloy is controlled on the basis of the average atom concentration of Cr in the precipitate.

When the average atom concentration of Cr contained in all the precipitates is as little as less than 0.1 at %, the grain of the microstructure of the copper alloy becomes large and bendability decreases. On the other hand, when the average atom concentration of Cr contained in the precipitates is as much as more than 80 at %, elements in a solid solution state other than Cr increase in the microstructure of the copper alloy, and thus electrical conductivity is decreased. Therefore, the average atom concentration of Cr contained in the precipitate is specified to be in the range of 0.1 to 80 at %, and preferably in the range of 0.5 to 50 at %.

(Average Grain Size)

In the invention, the grain size of the microstructure of the copper alloy refined by the control of the precipitate of the microstructure of the copper alloy is taken as a standard for substantially improving bendability, and the average grain size of the microstructure of the copper alloy is specified. That is, when the number of grains and a grain size of each of the grains are referred to as n and X, respectively, according to a measurement by a crystal orientation analysis method using a field emission scanning electron microscope with a magnification of 10,000 and a backscattered electron diffraction image system mounted thereon, an average grain size represented by $(\Sigma x)/n$ is specified to be 30 μm or less, more preferably 10 μm or less.

When the average grain size is as large as more than 30 μm, desired bendability in the invention cannot be obtained. Therefore, the average grain size is specified to be 30 μm or less, and more preferably 10 μm or less, to thereby refine the grain size.

Subsequently, as one of desirable aspects of the invention, a third aspect of the invention will be described.

(Element Composition of Copper Alloy)

First, a chemical element composition of a Corson-based alloy in accordance with the third aspect of the invention will be described, in which the alloy meets required strength and electrical conductivity as well as excellent bendability and stress relaxation resistance that are necessary for the above-mentioned purposes.

In the third aspect of the invention, in order to achieve high strength, high electrical conductivity, and excellent bendability, the basic composition thereof is constituted of a copper alloy containing, in terms of mass %, 0.4 to 4.0% of Ni, 0.05 to 1.0% of Si, and 0.005 to 1.0% of Ti, respectively, with the remainder being copper and inevitable impurities. The composition is a critical precondition of the element composition in order to enable a grain of a microstructure of the copper alloy to be refined and to control an average atom concentration of Ti contained in the precipitate ($Ni_2Si$). Hereinafter, % will indicate mass % to explain respective elements.

In addition to the basic composition, 0.005 to 3.0% of Zn may be contained. Additionally, 0.01 to 5.0% of Sn may be contained. Further, one or two or more kinds of Fe, Mg, Co, and Zr may be contained in a total amount of 0.01 to 3.0%.

0.4 to 4.0% of Ni

Since Ni crystallizes or precipitates a chemical compound ($Ni_2Si$ or the like) with Si, Ni ensures strength and electrical conductivity of the copper alloy. Additionally, Ni forms a chemical compound with Ti. When the Ni content is as little as less than 0.4%, a production of a precipitate is insufficient, and thus desired strength is not obtained and a grain of a microstructure of the copper alloy becomes large. Further, a ratio of a precipitate which easily segregates becomes large and non-uniformity of a final product increases. On the other hand, when the Ni content is as much as more than 4.0%, precipitate number density increases as well as electrical conductivity decreases, and thus bendability decreases. Therefore, the amount of Ni is specified to be in the range of 0.4 to 4.0%.

0.05 to 1.0% of Si

Since Si crystallizes or precipitates a chemical compound ($Ni_2Si$) with Ni, Si enables strength and electrical conductivity of the copper alloy to be improved. Additionally, Si forms a chemical compound with Ti. When the Si content is as little as less than 0.05%, a production of a precipitate is insufficient, and thus desired strength is not obtained and a grain of a microstructure of the copper alloy becomes large. Further, a ratio of a precipitate which easily segregates becomes large and non-uniformity of a final product increases. On the other hand, when the Si content is as much as more than 1.0%, the number of the precipitates becomes too large, bendability decreases as well as an atom number ratio Ti/Si of Ti and Si contained in the precipitate decreases. Therefore, the amount of Si is specified to be in the range of 0.05 to 1.0%.

0.005 to 1.0% of Ti

Ti is a critical element for forming a Ti-containing precipitate and for controlling an atom concentration of Ti in a Ti-containing precipitate in the above-mentioned specific range. By forming the Ti-containing precipitate, strength and electrical conductivity are improved, a grain becomes fine because of forming the Ti-containing precipitate, and thus bendability is improved. Herein, among the effects, especially the effect of improving bendability is exhibited by controlling the atom concentration of Ti of the Ti-containing precipitate within the above-mentioned specific range.

When the Ti content is as little as less than 0.005%, the function and the effect are not effectively exhibited. Meanwhile, when the Ti content is as much as more than 1.0% and more severely more than 0.6%, the precipitate becomes large, and bendability decreases as well as an atom concentration of Ti contained in the precipitate becomes too high. Therefore, the Ti content is specified to be in the range of 0.005 to 1.0%, more preferably 0.005 to 0.6%.

In this case, the Ti-containing precipitate mentioned in the invention represents the Ti-containing precipitate of Ni—Si—Ti in the basic composition of Ni—Si—Ti. When Fe, Mg, and the like are contained therein, the Ti-containing precipitate of Ni—Si—(Fe, Mg)—Ti and the like are formed in addition to or in place of the Ti-containing precipitate such as Ni—Si—Ti. Additionally, when Co, Zr and the like are contained therein, the Ti-containing precipitate is formed in such a manner that some or all of Fe, Mg and the like are substituted.

Fe, Mg, Co, and Zr in a Total Amount of 0.01 to 3.0%

Since these elements form the Ti-containing precipitate as described above, strength and electrical conductivity are improved as well as a grain refining is effective. In the case where the effect is exhibited, one or two or more kinds of Fe, Mg, Co, and Zr is selectively contained to the extent of 0.01% or more in total. However, when the total content (total amount) of these elements exceeds 3.0%, the precipitate becomes large, and bendability decreases as well as an atom concentration of Ti contained in the precipitate becomes too high. Therefore, the total content (total amount) of Fe, Mg, Co, and Zr is specified to be in the range of 0.01 to 3.0% in the case where one or more of the elements are selectively contained.

0.005 to 3.0% of Zn

Zn is an element which improves thermal ablation resistance of Sn plating or a soldering used for bonding electronic components and is effective for restraining a thermal ablation. In the case where the effect is effectively exhibited, Zn is selectively contained in an amount of 0.005% or more. However, when Zn is contained as much as more than 3.0%, the wettability and spreadability of molten Sn or solder are deteriorated. Additionally, when the content increases, electrical conductivity is greatly decreased. Therefore, Zn needs to be selectively contained in consideration of the effect of improving thermal ablation resistance and a reaction of decreasing electrical conductivity. In that case, Zn content is specified to be in the range of 0.005 to 3.0%, and more preferably in the range of 0.005 to 1.5%.

0.01 to 5.0% of Sn

Sn is contained in the copper alloy in a solid solution state and contributes for improving strength. In the case where the effect is effectively exhibited, Sn is selectively contained in an amount of 0.01% or more. However, when Zn is contained as much as more than 5.0%, the effect is saturated. Additionally, when the content increases, electrical conductivity is greatly decreased. Therefore, Sn needs to be selectively contained in consideration of the effect of improving strength and a reaction of decreasing electrical conductivity. In that case, Sn content is specified to be in the range of 0.01 to 5.0%, and more preferably in the range of 0.01 to 1.0%.

Content of Other Elements

The other elements are basically impurities and the contents thereof are preferably as low as possible. For example, the elements of the impurities such as Mn, Ca, Ag, Cd, Be, Au, Pt, S, Pb, and P easily form a large precipitate, and thus bendability is deteriorated as well as electrical conductivity is easily decreased. Therefore, it is preferable that the total content of these elements is as low as possible and 0.5% or less. Besides, the elements such as Hf, Th, Li, Na, K, Sr, Pd, W, Nb, Al, V, Y, Mo, In, Ga, Ge, As, Sb, Bi, Te, B, C and Mischmetal which are contained in the copper alloy in a small amount easily cause a decrease of electrical conductivity. Thus, it is preferable that the total content of these elements is as low as possible and 0.1% or less. However, in order to decrease the amounts of the elements, a base metal is used or a refining is performed, which increase a manufacturing cost. Therefore, in order to decrease the manufacturing cost, these elements may be contained within the upper limit of the above-mentioned range.

(Microstructure of Copper Alloy)

In the invention, in the state where the above-mentioned Cu—Ni—Si—Ti-based alloy composition is preconditioned, the microstructure of the copper alloy is designed, and the average grain size is decreased as fine as 20 μm or less, and more preferably 10 μm or less, thereby improving bendability of the copper alloy. In the invention, the design of the microstructure is achieved by controlling an amount of the Ti-containing precipitate. More specifically, the design of the microstructure is achieved by a control that a certain amount of the number density of the precipitate having a certain size is ensured in the microstructure of the copper alloy and a certain degree of the average atom concentration of Ti contained in the precipitate having the certain size is ensured.

When the design of the microstructure is not achieved by the above-mentioned control, it is not possible to ensure an adequate amount of the Ti-containing precipitate that has a large pinning effect of restraining a grain growth in the microstructure of the copper alloy. As a result, in such a case, it is difficult to refine the average grain size of the microstructure of the copper alloy to be 20 μm or less, and more preferably 10 μm or less. As described above, the Ti-containing precipitate of the invention is not completely contained in a sold solution state even when the solution treatment temperature is high, remains in a form of the precipitate in the microstructure, and exerts the pinning effect of greatly restraining the grain growth. However, as described above, the degree of the pinning effect of the Ti-containing precipitate is largely dependent on the average atom concentration of Ti contained in the precipitate having a size of 50 to 200 nm and the number density of the precipitate having a size of 50 to 200 nm.

(Number Density of Precipitate)

However, as a precondition, it is necessary that the number density of the precipitate present in the microstructure of the copper alloy is guaranteed. When the number density of the precipitate present in the microstructure of the copper alloy is too small or too large, the effect of improving bendability is not sufficiently exhibited even if the average atom concentration of Ti or the average atom concentration of Ti and Si contained in the precipitate is controlled. Therefore, in the invention, in order to guarantee the grain size refining effect due to the precipitate, the number density of a precipitate having a specific size is specified to be in a specific range.

That is, the number density of the precipitate having a size of 50 to 200 nm in the microstructure of the copper alloy, which is measured by the field emission transmission electron microscope and the energy dispersive analyzer, is specified to be in the range of 0.2 to 20 per $\mu m^2$. The precipitate having the specific size has a selection standard caring about only the size (maximum diameter) of the precipitate regardless of containing Ti.

When the number density of the precipitate is less than 0.2 per $\mu m^2$, the number of precipitate is too small. Accordingly, the grain size refining effect is not sufficiently exhibited even when the average atom concentration of Ti or Ti and Si contained in the precipitate is controlled, and thus the grain becomes large and bendability may be decreased.

On the other hand, when the number density of the precipitate is more than 20 per $\mu m^2$, the number of precipitate is too large and a formation of a shear band is promoted at the time of bending process, and thus bendability is decreased. Therefore, the number density of the precipitate having a size of 50 to 200 nm is specified to be in the range of 0.2 to 20 per $\mu m^2$, and more preferably in the range of 0.5 to 15 per $\mu m^2$.

(Average Atom Concentration of Ti Contained in Precipitate)

In a state that the number density of the precipitate is guaranteed, in the invention, in order to refine the average grain size in the microstructure of the copper alloy so as to be 20 μm or less, the average atom concentration of Ti contained in the precipitate in the microstructure of the copper alloy such as Ni—Si—Ti, which has a size of 50 to 200 nm, is controlled to be in the range of 0.1 to 50 at %, in which the average atom concentration is measured using the field emission transmission electron microscope with a magnification of 30,000 and the energy dispersive analyzer.

As described above, in the invention, the amount of the Ti-containing precipitate present in the microstructure of the copper alloy is not directly specified, but is controlled on the basis of the average atom concentration of Ti in the precipitate having the specific size (50 to 200 nm) present in the microstructure of the copper alloy. Therefore, in the invention, the atom concentration of Ti is measured for all of the precipitates (precipitate regardless of containing Ti) having the specific size, and the amount of the Ti-containing precipitate in the microstructure of the copper alloy is controlled on the basis of the average atom concentration of Ti in the precipitate.

When the average atom concentration of Ti contained in all the precipitates is as little as less than 0.1 at %, the grain of the microstructure of the copper alloy becomes large and bendability decreases. On the other hand, when the average atom concentration of Ti contained in the precipitates is as much as more than 50 at %, elements in a solid solution state other than Cr increase in the microstructure of the copper alloy, and thus electrical conductivity is decreased. Therefore, the average atom concentration of Ti contained in the precipitate is specified to be in the range of 0.1 to 50 at %, and preferably in the range of 0.5 to 40 at %.

(Average Grain Size)

In the invention, the grain size of the microstructure of the copper alloy refined by the control of the precipitate of the microstructure of the copper alloy is taken as a standard for substantially improving bendability, and the average grain size of the microstructure of the copper alloy is specified. That is, when the number of grains and a grain size of each of the grains are referred to as n and X, respectively, according to a measurement by a crystal orientation analysis method using a field emission scanning electron microscope with a magnification of 10,000 and a backscattered electron diffraction image system mounted thereon, an average grain size represented by $(\Sigma x)/n$ is specified to be 20 μm or less, more preferably 10 μm or less.

When the average grain size is as large as more than 20 μm, desired bendability in the invention cannot be obtained. Therefore, the average grain size is specified to be 20 μm or less, and more preferably 10 μm or less, to thereby refine the grain size.

(Method of Measuring Number Density of Precipitate)

A method of measuring number density of the precipitate is a previous step of the average atom concentration measurement of M contained in the precipitate. Specifically, a sample is acquired from the produced final copper alloy (sheet and the like), and a film sample for TEM observation is prepared by means of an electro polishing. A bright field image with a magnification of 30,000 is acquired from the sample by means of, for example, HF-2200 field emission transmission electron microscope (FE-TEM) manufactured by Hitachi, Ltd. The bright field image is printed and developed, and the diameter and number of the precipitates are measured on the basis of the photograph. At this time, the precipitates having a maximum diameter in the range of 50 to 200 nm are specified. From the measurement, the number density (per $\mu m^2$) of the precipitate in the range of 50 to 200 nm may be obtained.

(Method of Measuring Average Atom Concentration of M Contained in Precipitate)

By using, for example, an NSS energy dispersive analyzer (EDX) manufactured by Noran Instruments, Inc, an element quantitative analysis of the precipitate is performed to the precipitates in the same bright field image acquired by the field emission transmission electron microscope with a magnification of 30,000, by which the number density of the precipitate is measured. At the time of performing the analysis, the beam diameter is specified to be 5 nm or less. The analysis is performed to only the precipitate having the maximum diameter in the range of 50 to 200 nm (the analysis is not performed to the precipitate having the size out of the range). The atom concentration (at %) of M and Si in the precipitates (all of precipitates) within the visual field are measured, respectively. Then, the average atom concentrations of M and Si contained in the precipitate in the bright field image are calculated.

(Method of Measuring Atom Number Ratio of M and Si Contained in Precipitate)

Based on the measurement of the average atom concentration of M and Si contained in the precipitate (among precipitate), an average atom number ratio M/Si of M and Si contained in the precipitate having a size of 50 to 200 nm may be obtained.

In order to improve repeatability and precision of the measurement and calculation, the samples for a measurement sampled from the copper alloy are specified to 10 samples from optional 10 positions, and the values of the average atom concentration of M and Si contained in the precipitate, the atom number ratio M/Si of M and Si, the number density of the precipitate, and the like are specified to an average of those of the 10 samples.

(Method of Measuring Average Grain Size)

In the invention, the method of measuring the average grain size is specified to be performed by a crystal orientation analysis method using the field emission scanning electron microscope (FESEM) on which a electron back scattering (scattered) pattern (EBSP) system is mounted. The reason is that the measurement method has high precision because of a high resolution.

In the EBSP method, electron beam is irradiated to the sample specified to be in a lens tube of FESEM so as to project EBSP onto a screen. This projected one is photographed by a high-sensitive camera and the photographed one is read by a computer as an image. The computer analyzes the image so as to determine the crystal orientation by comparing with the pattern acquired from a simulation using a known crystal system. The acquired crystal orientation is recorded with a position coordinate (x, y) and the like as a three-dimensional Euler Angle. Since the process is automatically performed to all of the measurement points, more than ten thousand of crystal orientation data are acquired at the time of ending the measurement.

As described above, the EBSP method has benefits such that the EBSP method has a larger observation angle than those of an X-ray diffraction method or an electron diffraction method using the transmission electron microscope and the average grain size, a standard deviation of the average grain size or orientation analysis information of more than hundreds of multiple grains can be obtained within several hours. Further, since the measurement is performed by scanning a specified area with a predetermined gap instead of every grain, the ESBP method has another benefit such that the above-mentioned information of the multiple measurement points in addition to the entire measurement area can be obtained. In this regard, a detail of the crystal orientation analysis method in which the EB SP system is mounted on the FESEM is described in Kobe Steel Engineering reports/Vol. 52 No. 2 (September 2002) P.66-70 etc.

By using the crystal orientation analysis method in which the EBSP system is mounted on the FESEM, in the invention, the texture of the surface of the copper alloy product is measured in the direction of the sheet thickness and the average grain size is measured.

In a normal copper alloy sheet, a texture is mainly formed of the following orientation factors such as a Cube orientation, a Goss orientation, a Brass orientation (Hereinafter, referred to a B orientation), a Copper orientation (Hereinafter, referred to a Cu orientation), a S orientation, and the like, and crystal planes based on them are present. The detail thereof is specifically described in, for example, "Texture" written by Shinichi Nagashima, published by Maruzen Co., Ltd and "Light Metal" description Vol. 43, 1993, P.285-293 published by Japan Institute of Light Metals, and the like.

The texture is differently formed depending on a processing and a heat treatment even in the case where the crystal system is the same. The texture of a sheet material by a rolling is represented by a rolling surface and a rolling direction, and the rolling surface is expressed by {ABC} and the rolling direction is expressed by <DEF> (A, B, C, D, E, and F denote a constant number). Based on the expressions, each of the orientation is expressed as follows.

| | |
|---|---|
| Cube Orientation | {001} <100> |
| Goss Orientation | {011} <100> |
| Rotated-Goss Orientation | {011} <011> |
| Brass Orientation (B Orientation) | {011} <211> |
| Copper Orientation (Cu Orientation) | {112} <111> |
| (Alternatively, D Orientation {4 4 11} <11 11 8>) | |
| S Orientation | {123} <634> |
| B/G Orientation | {011} <511> |
| B/S Orientation | {168} <211> |
| P Orientation | {011} <111> |

In the invention, basically those deviating from these crystal planes within the range of ±15° are considered to belong to the same crystal planes (orientation factor). Additionally, the boundary of the grain in which the orientation difference between adjacent grains is not less than 5° is defined as a grain boundary.

Further, in the invention, electron beam having 0.5 μm of pitch is irradiated to a measurement area of 300 μm×300 μm, and when the number of the grains and the grain size of each of the grains that are measured by the crystal orientation analysis method are referred to n and x, respectively, the average grain size is calculated from the equation $(\Sigma x)/n$.

(Production Condition)

Next, preferable production conditions to make the copper alloy compatible with the above-described microstructure that is specified according to the invention will be described below. The copper alloy of the invention is basically a copper alloy sheet, and a strip prepared by cutting the sheet in a widthwise direction and a coil made from the sheet or strip are also included in the scope of the copper alloy of the invention.

In the invention, in the same manner as a normal production process, a final (product) sheet is produced by processes such that a copper alloy melt adjusted to have the above-described preferable chemical compound composition is molded and the resulting ingot is subjected to a facing, soaking, a hot rolling, a cold rolling, a solution treatment (recrystallization annealing), an age-hardening (precipitation annealing), a distortion correcting annealing, and the like. However, among the above-mentioned production processes, preferable production conditions described below are respectively performed in combination, whereby it is possible to obtain the copper alloy compatible with the above-described microstructure, strength, electric electrical conductivity, and bendability specified according to the invention.

First, it is preferable that the finishing temperature of hot rolling is specified to be in the range of 550 to 850° C. When the hot rolling is performed at the temperature of less than 550° C., the recrystallization is not complete and the microstructure becomes non-uniform, thereby deteriorating bendability. When the finishing temperature of hot rolling is more than 850° C., the grain becomes large and thus the bendability deteriorates. After the hot rolling, it is preferable that a water cooling is performed.

Next, after the hot rolling, it is preferable that a cold reduction rate during the cold rolling is in the range of 70 to 98% before the solution treatment (recrystallization annealing). When the cold reduction rate is less than 70%, since a recrystallization nucleus site is very small, the average grain size inevitably becomes larger than that of the invention, and thus bendability may be decreased. Further, when the cold reduction rate is more than 98%, since a non-uniform distribution of distortion becomes large, the grain size becomes non-uniform after the recrystallization, and thus preferable bendability of the invention may be decreased.

(Solution Treatment)

The solution treatment is a critical process in that the grain size becomes fine by controlling the precipitate of the microstructure of the copper alloy of the invention and thus bendability of the copper alloy is improved. In particular, the raising temperature speed at the time of starting the solution treatment and the cooling speed from the solution treatment temperature at the time of ending the solution treatment are critically controlled so as to control the precipitate of the microstructure of the copper alloy.

For this reason, in the first aspect of the invention, during the solution treatment, the average raising temperature speed up to 400° C. is specified to be in the range of 5 to 100° C./h, the average raising temperature speed from 400° C. to the solution treatment temperature is specified to be 100° C./s or higher, the solution treatment temperature is specified to be 700° C. or higher but lower than 900° C., and the average cooling speed after the solution treatment is specified to be 50° C./s or higher, respectively.

During raising temperature and cooling in the solution treatment process, first, the precipitate such as $Ni_2Si$ is formed in the relatively low-temperature range of from room temperature to 600° C., and the precipitate is contained in a solid solution state again in the high-temperature range of 600° C. or higher. Additionally, the recrystallization temperature range of the copper alloy of the invention is in the range of about 500° C. to 700° C., and the grain size of the copper alloy is largely dependent on a dispersion state of the precipitate at the time of the recrystallization.

The average raising temperature speed is relatively specified to be small from the time of raising temperature for the solution to the time of reaching 400° C., such as the range of 5 to 100° C./h. However, when the average raising temperature speed is lower than 5° C./h, the acquired precipitate becomes large and the average grain size becomes large. Thus, bendability is decreased. On the other hand, when the average raising temperature speed is higher than 100° C./h, the production amount of the precipitate becomes small. For this reason, the number density of the precipitate is not sufficient and the average grain size becomes large. Thus, bendability is decreased.

Next, the average raising temperature speed is relatively specified to be large from 400° C. to the solution temperature, such as 100° C./s or higher. When the raising temperature speed is lower than 100° C./s, the growth of the recrystallization grain is promoted and the average grain size becomes large. Thus, bendability is decreased.

The solution treatment temperature is specified to be in the range of 700° C. or higher but lower than 900° C. When the solution treatment temperature is lower than 700° C., the solution becomes insufficient, and thus preferable high strength of the invention is not obtained as well as bendability is decreased. On the other hand, when the solution treatment temperature is 900° C. or higher, the number density of the precipitate becomes very small as well as the atom concentration of P contained in the precipitate becomes very small, and thus it is not possible to obtain the desirable bendability and high electrical conductivity required in the invention.

The average cooling speed after the solution treatment is specified to be 50° C./s or higher. When the cooling speed is lower than 50° C./s, the grain growth is promoted, and thus the average grain size becomes larger than that of the invention as well as bendability is decreased.

Further, in the second aspect of the invention, during the solution treatment, the average raising temperature speed up to 400° C. is specified to be in the range of 5 to 100° C./h, the average raising temperature speed from 400° C. to the solution treatment temperature is specified to 100° C./s or higher, the solution treatment temperature is specified to in the range of 700° C. or higher but lower than 950° C., and the average cooling speed after the solution treatment is specified to 50° C./s or higher, respectively.

During raising temperature and cooling in the solution treatment process, first, the precipitate such as $Ni_2Si$ is formed in the relatively low-temperature range of from room temperature to 600° C., and the precipitate is contained in a solid solution state again in the high-temperature range of 600° C. or higher. Additionally, the recrystallization temperature range of the copper alloy of the invention is in the range of about 500° C. to 700° C., and the grain size of the copper alloy is largely dependent on the dispersion state of the precipitate at the time of the recrystallization.

The average raising temperature speed is relatively specified to be small from the time of raising temperature for the solution to the time of reaching 400° C., such as the range of 5 to 100° C./h. However, when the average raising temperature speed is lower than 5° C./h, the acquired precipitate becomes large and the average grain size becomes large. Thus, bendability is decreased. On the other hand, when the average raising temperature speed is higher than 100° C./h, the production amount of the precipitate becomes small. For this reason, the number density of the precipitate is not sufficient and the average grain size becomes large. Thus, bendability is decreased.

Next, the average raising temperature speed is relatively specified to be large from 400° C. to the solution temperature, such as 100° C./s or higher. When the raising temperature speed is lower than 100° C./s, the growth of the recrystallization grain is promoted regardless of the specified precipitate of the invention and the average grain size becomes large. Thus, bendability is decreased.

The solution treatment temperature is specified to be relatively high-temperature in the range of 700° C. or higher but less than 950° C. When the solution treatment temperature is lower than 700° C., the solution becomes insufficient, and thus preferable high strength of the invention is not obtained as well as bendability is decreased. On the other hand, when the solution treatment temperature is 950° C. or higher, most of the Cr-containing precipitate are contained in a solid solution state, and thus the number density of the precipitate becomes very small as well as the atom concentration of Cr contained in the precipitate becomes very small. For this reason, the pinning effect of restraining the grain growth due to the Cr-containing precipitate is not exhibited, and thus the grain becomes large. For this reason, preferable high strength, bendability, and electrical conductivity of the invention are not obtained.

The solution treatment temperature is relatively specified to be a high-temperature. As described above, even when the solution treatment temperature is high, the Cr-containing precipitate is not completely contained in a solid solution state, remains in a form of the precipitate in the microstructure, and exhibits the large pinning effect for restraining the grain growth. Moreover, as described above, since the solution treatment temperature is high-temperature, the amounts of Ni and Si that are contained in a solid solution state may be largely increased, and thus during an age-hardening process, the amount of the fine precipitate of Ni—Si may be largely increased. As a result, it is possible to enable the copper alloy to have high strength without decreasing bendability and the like due to average grain-size growth.

The average cooling speed after the solution treatment is specified to 50° C./s or higher. When the cooling speed is lower than 50° C./s, the grain growth is promoted regardless of the specified precipitate of the invention, and thus the average grain size becomes larger than that of the invention as well as bendability is decreased.

Additionally, in the third aspect of the invention, during the solution treatment, the average raising temperature speed up to 400° C. is specified to be in the range of 5 to 100° C./h, the average raising temperature speed from 400° C. to the solution treatment temperature is specified to 100° C./s or higher, the solution treatment temperature is specified to in the range of 700° C. or higher but lower than 950° C., and the average cooling speed after the solution treatment is specified to 50° C./s or higher, respectively.

During raising temperature and cooling in the solution treatment process, first, the precipitate such as $Ni_2Si$ is formed in the relatively low-temperature range of from the room temperature to 600° C., and the precipitate is contained in a solid solution state again in the high-temperature range of 600° C. or higher. Additionally, the recrystallization temperature range of the copper alloy of the invention is in the range of about 500° C. to 700° C., and the grain size of the copper alloy is largely dependent on the dispersion state of the precipitate at the time of the recrystallization.

The average raising temperature speed is relatively specified to be small from the time of raising temperature for the solution to the time of reaching 400° C., such as the range of 5 to 100° C./h. However, when the average raising temperature speed is lower than 5° C./h, the acquired precipitate becomes large and the average grain size becomes large. Thus, bendability is decreased. On the other hand, when the average raising temperature speed is higher than 100° C./h, the production amount of the precipitate becomes small. For this reason, the number density of the precipitate is not sufficient and the average grain size becomes large. Thus, bendability is decreased.

Next, the average raising temperature speed is relatively specified to be large from 400° C. to the solution temperature, such as 100° C./s or higher. When the raising temperature speed is lower than 100° C./s, the growth of the recrystallization grain is promoted regardless of the specified precipitate of the invention and the average grain size becomes large. Thus, bendability is decreased.

The solution treatment temperature is specified to be relatively high-temperature in the range of 700° C. or higher but less than 950° C. When the solution treatment temperature is lower than 700° C., the solution becomes insufficient, and thus preferable high strength of the invention is not obtained as well as bendability is decreased. On the other hand, when the solution treatment temperature is 950° C. or higher, most of the Ti-containing precipitate are contained in a solid solution state, and thus the number density of the precipitate becomes very small as well as the atom concentration of Ti contained in the precipitate becomes very small. For this reason, the pinning effect of restraining the grain growth due to the Ti-containing precipitate is not exhibited, and thus the grain becomes large. For this reason, preferable high strength, bendability, and electrical conductivity of the invention are not obtained.

The solution treatment temperature is specified to be relatively high-temperature. As described above, even when the solution treatment temperature becomes high, the Ti-containing precipitate is not completely contained in a solid solution state, remains in a form of the precipitate in the microstructure, and exhibits the large pinning effect for restraining the grain growth. Moreover, as described above, since the solution treatment temperature is high-temperature, the amounts of Ni and Si that are contained in a solid solution state may be largely increased, and thus during an age-hardening process, the amount of the fine precipitate of Ni—Si may be largely increased. As a result, it is possible to enable the copper alloy to have high strength without decreasing bendability and the like due to the average grain-size growth.

The average cooling speed after the solution treatment is specified to be 50° C./s or higher. When the cooling speed is lower than 50° C./s, the grain growth is promoted regardless of the specified precipitate of the invention, and thus the average grain size becomes larger than that of the invention as well as bendability is decreased.

(Process after Solution Treatment)

After the solution treatment (after recrystallization annealing), strength and electrical conductivity of the copper alloy sheet may be improved (restored) by performing a precipitation annealing (process annealing, second annealing) in the temperature range of about 300 to 450° C. so as to form the fine precipitate. Additionally, a final cold rolling may be performed in the range of 10 to 50% between the solution treatment and the precipitation annealing.

By performing the above-mentioned production conditions in an adequate combination manner, it is possible to obtain the copper alloy with high strength, high electrical conductivity, and excellent bendability. Since the copper alloy of the invention obtained by the above-mentioned conditions has high strength, high electrical conductivity, and excellent bendability, the copper alloy may be widely and effectively used for appliances, semiconductor components, industrial machines, and electric/electronic components for a vehicle.

Hereinafter, the invention will be described in further detail with reference to examples. However, the invention is not limited to the examples as set forth below and various modifications can be suitably made without departing from the range of the spirit or scope of the invention as set forth in the above and following descriptions. Thus, all such modifications are intended to be included within the technical scope of the invention.

EXAMPLES

Hereinafter, first example of the invention will be described. After varying the average grain size of a Cu alloy sheet acquired under the condition that a Cu alloy composition, a production method thereof, and particularly a solution treatment condition are varied and P average atom concentration and the like of the precipitate in the microstructure of the Cu alloy are varied, strength, electrical conductivity, bendability, and the like are evaluated, respectively.

Specifically, each copper alloy having the chemical element composition shown in Tables 1 and 2 was melted in a kryptol furnace in the state where the copper alloy is coated with coal at the atmosphere, the copper alloy was molded in a cast-iron book mold, and thus an ingot of 50 mm in thickness, 75 mm in width, and 180 mm in length was obtained. The surface of each ingot was subjected to a facing. Thereafter, hot rolling was performed at 950° C. to prepare a sheet of 20 mm in thickness, and the resulting sheet was quenched in water from a hot rolling finishing temperature of 750° C. or more. Next, oxidized scale was removed and, thereafter, the primary cold rolling was performed, and thus obtaining copper alloy sheet of 0.25 mm in thickness.

Subsequently, as shown in Tables 2 and 3, the solution treatment was performed by variously varying the raising temperature and cooling conditions using a salt bath. Additionally, the copper alloy sheet was commonly held at the solution temperature for 30 seconds. A finish cold rolling was performed to thereby yield a cold rolled sheet of about 0.20 mm in thickness. An artificial age-hardening process of 450° C.×4 h was performed to the cold rolled sheet, and thus obtaining a final copper alloy sheet.

In each example, samples were cut from the thus produced copper alloy sheet, and by using the samples, a microstructure investigation, a strength (0.2% proof strength) measurement via a tensile test, an electrical conductivity measurement, and a bending test were performed. The results are shown in Tables 3 and 4.

In each copper alloy shown in Tables 1 and 2, the remainder other than described element contents was Cu, and impurity elements such as Al, Be, V, Nb, Mo, and W other than described element contents shown in Tables 1 and 2 were specified to be 0.5% or less in total. Besides, elements such as B, C, Na, S, Ca, As, Se, Cd, In, Sb, Bi, and MM (Mischmetal) were specified to be 0.1% or less. Further, in each of element contents shown in Tables 1 and 2, "-" denotes a state below a detection limit.

In the microstructure investigation of the copper alloy sample, the average atom concentration (at %) of P contained in the precipitate having a size of 50 to 200 nm, the average atom number ratio P/Si of P and Si contained in the precipitate having the same size of 50 to 200 nm, the average number density (per $\mu m^2$) of the precipitate having the same size of 50 to 200 nm were measured on the basis of the above-mentioned methods, respectively.

Additionally, when the number of grains and the grain size of the microstructure of the copper alloy sample were referred to n and x, the average grain size (μm) expressed by $(\Sigma x)/n$ was measured by a crystal orientation analysis method in which a backscattered electron diffraction image system is mounted on the field emission scanning electron microscope. Specifically, a mechanical polishing, a buffing, and an electrolytic polishing were performed to the rolling surface of the copper alloy, and thus preparing a sample in which its surface was adjusted. Subsequently, a crystal orientation and a grain size were measured by EBSP using FESEM (JEOL JSM 5410) manufactured by NEC Corporation. The measured area is 300 μm×300 μm, and the measurement step was specified to be every 0.5 μm. An EBSP measurement and analysis system was performed using EBSP manufactured by TSL Corporation (OIM).

(Tensile Test)

In the tensile test, JIS13 B sample in which a test piece's length direction coincides with a rolling direction was used, 0.2% proof strength (MPa) was measured using 5882-type universal testing machine manufactured by Instron Corporation at room temperature under a condition that a test speed is 10.0 mm/min and GL is 50 mm. Under the same condition, three test pieces were tested and the average of them was adopted.

(Electrical Conductivity Measurement)

The copper alloy sheet sample was processed into a slip-shaped test piece of 10 mm in width and 300 mm in length by milling, an electric resistance was measured with a double bridge resistance meter, and the electrical conductivity was calculated by an average cross-sectional area method. Under the same condition, three test pieces were tested and the average of them was adopted.

(Evaluation Test of Bending Workability)

A bending test of the copper alloy sheet sample was performed in conformity with Japan Copper and Brass Association Standard. A test piece of 10 mm in width and 30 mm in length was taken from each sample, Good Way bending (the bending axis is perpendicular to the rolling direction) was performed at bending radius of 0.15 mm by applying 1000 kgf of load thereto, and the presence or absence of cracking at the bending portion was visually observed under an optical microscope at a magnification of 50. At this time, samples having no crack are indicated by o, and samples having a crack are indicated by x. When the result is excellent in the bending test, bendability is also good enough to endure the sharp bending or 90° bending after notching and the like.

As was clear from Tables 1 and 3, with regard to copper alloys of Inventive Examples 1 to 18 which had compositions within the range of the invention, solution treatment was performed under preferable conditions, and thus obtaining a product copper alloy sheet.

For this reason, in microstructures of Inventive Examples 1 to 18, on the basis of the above-mentioned measurement methods, the average number density of the precipitates in the range of 50 to 200 nm was in the range of 0.2 to 7.0 per $\mu m^2$, the average atom concentration of P contained in the precipitates having the same size was in the range of 0.1 to 50 at %, and the average grain size was 10 μm or less. Additionally, the average atom number ratio P/Si of P and Si contained in the precipitate having a size of 50 to 200 nm was in the range of 0.01 to 10.

As a result, Inventive Examples 1 to 18 had 0.2% proof strength of 800 MPa or more and electrical conductivity of 40% IACS or more, which were high strength and high electrical conductivity. Additionally, Inventive Examples had excellent bendability.

On the other hand, in the copper alloys of Comparative Examples 19 to 27 and 33 to 35, the chemical compositions were out of the range that the invention specified. For this reason, even though the solution treatment (production method) was performed within a preferable condition range, the bendability was low for each Example, and thus the strength and electrical conductivity were also low.

In the copper alloy of Comparative Example 19, P was not contained. For this reason, the average atom concentration of P contained in the precipitate was 0 and the average grain size was as large as more than 10. For this reason, the bendability and strength were low.

In the copper alloy of Comparative Example 20, the Ni content largely exceeded the upper limit thereof. For this reason, the bendability and electrical conductivity were outstandingly low.

In the copper alloy of Comparative Example 21, the Ni content largely exceeded the lower limit thereof. For this reason, even though the average atom concentration of P contained in the precipitate having a size of 50 to 200 nm was 4 at %, the average grain size was as large as more than 10 μm. As a result, the bendability and strength were outstandingly low.

In the copper alloy of Comparative Example 22, the Si content largely exceeded the upper limit thereof. For this reason, even though the average atom concentration of P contained in the precipitate having a size of 50 to 200 nm was 1.5 at %, the average grain size was large as more than 10 μm. As a result, the bendability and electrical conductivity were outstandingly low.

In the copper alloy of Comparative Example 23, the Si content largely exceeded the lower limit thereof. For this reason, the number density of the precipitate having a size of 50 to 200 nm was too small. Even though the average atom concentration of P contained in the precipitate having the same size was 20 at %, the average grain size was as large as more than 10 μm. As a result, the bendability and electrical conductivity were outstandingly low.

In the copper alloy of Comparative Example 24, the P content largely exceeded the upper limit thereof. For this reason, the bendability and electrical conductivity were outstandingly low.

In the copper alloy of Comparative Example 25, the average atom concentration of P contained in the precipitate having a size of 50 to 200 nm was too small and Fe content largely exceeded the upper limit of 3.0%. For this reason, the average grain size was as large as more than 10 μm. As a result, the bendability and electrical conductivity were outstandingly low.

In the copper alloy of Comparative Example 26, the average atom concentration of P contained in the precipitate having a size of 50 to 200 nm was too small and contents of Cr and Co largely exceeded the upper limit of 3.0%. For this reason, the average grain size was as large as more than 10 μm. As a result, the bendability and electrical conductivity were outstandingly low.

Further, in the copper alloy of Comparative Examples 27 to 35, the chemical compound composition was in the specific range of the invention, but the solution treatment condition (production method) was out of the preferable condition range. As a result, the bendability was low for each Comparative Example, and thus the strength and electrical conductivity were low.

In the solution treatment of Comparative Example 27, the average raising temperature speed was too low up to 400° C. For this reason, the average atom concentration of P contained in the precipitate having a size of 50 to 200 nm was 3.7 at %. So, even though the average grain size was 6 μm, the bendability and strength were outstandingly low.

In the solution treatment of Comparative Example 28, the average raising temperature speed was too high up to 400° C. For this reason, the number density of the precipitate is insufficient, the average grain size was large, and bendability was low.

In Comparative Example 29, the average raising temperature speed was too low from 400° C. to the solution temperature. For this reason, the average grain size was large, and thus bendability was low.

In Comparative Example 30, the solution treatment temperature was too low. For this reason, the solution was incomplete, and thus strength was low and bendability was low.

In Comparative Example 31, the solution treatment temperature was too high.

For this reason, the number density of the precipitate having a size of 50 to 200 nm was too small, the average atom concentration of P contained in the precipitate having the same size was as small as 0.2 at %, and the average grain size was as large as 10 μm or more. As a result, the bendability and electrical conductivity were low.

In Comparative Example 32, the average cooling speed was too small after the solution treatment. For this reason, even though the number density of the precipitate having a size of 50 to 200 nm and the average atom concentration of P contained in the precipitate were in the specific range, the grain growth was promoted, and thus the average grain size was large as well as bendability was low. Further, strength was low.

In the copper alloy of Comparative Examples 33 and 35, P was not contained. Contents of Cr and Co largely exceeded the upper limit of 3.0%. Additionally, the solution treatment temperature was too high, and the number density of the precipitate having a size of 50 to 200 nm was too small. For this reason, the average grain size was as large as more than 10 μm, and thus bendability was low. Further, electrical conductivity was outstandingly low.

In Comparative Example 34, the number density of the precipitate having a size of 50 to 200 nm was too small. Even though the average atom concentration of P contained in the precipitate having the same size was in the specific range, the average grain size was as large as more than 10 μm. As a result, the bendability and strength were low.

The above-described results corroborate the significance of the element composition and microstructure of the copper alloy sheet of the invention to achieve high strength and high electrical conductivity as well as excellent bendability, and the significance of preferable production conditions to attain the microstructure.

TABLE 1

| | | Chemical element composition of copper alloy sheet (remainder: Cu and impurities) | | | | | | | | | | | |
|---|---|---|---|---|---|---|---|---|---|---|---|---|---|
| Case | No. | Ni | Si | P | Cr | Ti | Fe | Mg | Co | Zr | Zn | Sn | Comment |
| Inventive Example | 1 | 3.5 | 0.8 | 0.1 | — | — | — | — | — | — | 1 | 0.2 | |
| | 2 | 3.5 | 0.8 | 0.1 | — | — | — | — | — | — | 1 | 0.2 | |
| | 3 | 3.2 | 0.7 | 0.05 | — | — | — | — | — | — | — | — | |
| | 4 | 3.9 | 0.7 | 0.05 | — | — | — | — | — | — | — | — | Upper Limit of Ni |
| | 5 | 2 | 1 | 0.1 | — | — | — | — | — | — | — | — | Upper Limit of Si |
| | 6 | 3.2 | 0.7 | 0.4 | — | — | — | — | — | — | — | — | Upper Limit of P |
| | 7 | 3.5 | 0.8 | 0.01 | — | — | — | — | — | — | — | — | Lower Limit of P |
| | 8 | 3.2 | 0.7 | 0.05 | — | — | 0.2 | — | — | — | — | — | |
| | 9 | 3.3 | 0.8 | 0.03 | — | 0.11 | — | 0.1 | 0.05 | — | — | — | |
| | 10 | 3.5 | 0.7 | 0.07 | 0.15 | — | 0.2 | — | — | 0.1 | — | — | |
| | 11 | 3.2 | 0.7 | 0.05 | — | — | — | — | — | — | 0.5 | — | |
| | 12 | 3.2 | 0.7 | 0.05 | — | — | — | — | — | — | 1 | 0.2 | |
| | 13 | 3.2 | 0.7 | 0.00 | — | — | 0.05 | — | — | — | — | — | |
| | 14 | 3.2 | 0.7 | 0.05 | — | — | — | — | — | — | — | — | |
| | 15 | 3.2 | 0.7 | 0.05 | — | — | 0.01 | — | — | — | 1 | 0.5 | |
| | 16 | 3.2 | 0.7 | 0.05 | — | — | — | — | — | — | — | — | |
| | 17 | 3.8 | 0.8 | 0.05 | — | 0.1 | — | — | — | — | 0.5 | — | |
| | 18 | 3.2 | 0.7 | 0.05 | — | — | — | — | — | — | — | — | |

*In expression of the content of each element, "—" indicates that the content is less than a detection limit.

TABLE 2

| | | Chemical element composition of copper alloy sheet (remainder: Cu and impurities) | | | | | | | | | | | |
|---|---|---|---|---|---|---|---|---|---|---|---|---|---|
| Case | No. | Ni | Si | P | Cr | Ti | Fe | Mg | Co | Zr | Zn | Sn | Comment |
| Comparative Example | 19 | 3.2 | 0.7 | — | — | — | — | — | — | — | — | — | Inexistence of P |
| | 20 | 4.3 | 0.8 | 0.05 | — | — | — | — | — | — | — | — | Excess of Ni |
| | 21 | 0.3 | 0.5 | 0.05 | — | — | — | — | — | — | — | — | Shortage of Ni |
| | 22 | 3.5 | 1.2 | 0.05 | — | — | — | — | — | — | — | — | Excess of Si |
| | 23 | 3.2 | 0.01 | 0.05 | — | — | — | — | — | — | — | — | Shortage of Si |
| | 24 | 3.2 | 0.8 | 0.8 | — | — | — | — | — | — | — | — | Excess of P |
| | 25 | 3.2 | 0.7 | 0.1 | — | — | 4 | — | — | — | — | — | Excess of Fe |
| | 26 | 3.2 | 0.7 | 0.1 | 2 | — | — | — | 2 | — | — | — | Excess of CrCo |
| | 27 | 3.2 | 0.7 | 0.05 | — | — | 0.1 | — | — | — | — | — | Within specific range |
| | 28 | 3.2 | 0.7 | 0.05 | — | — | — | — | — | — | — | — | Within specific range |
| | 29 | 3.2 | 0.7 | 0.05 | — | — | — | — | — | — | — | — | Within specific range |
| | 30 | 3.2 | 0.7 | 0.05 | — | — | — | — | — | — | — | — | Within specific range |
| | 31 | 3.2 | 0.7 | 0.05 | — | — | — | — | — | — | — | — | Within specific range |
| | 32 | 3.2 | 0.7 | 0.05 | 0.05 | — | — | 0.05 | — | 0.05 | — | — | Within specific range |
| | 33 | 4 | 0.9 | — | — | — | — | — | — | — | — | 4 | Inexistence of P |
| | 34 | 2.5 | 0.5 | 0.03 | — | — | — | — | — | 2 | — | — | Within specific range |
| | 35 | 3.7 | 0.96 | — | — | — | — | — | — | — | 2 | 1.5 | Inexistence of P |

*In expression of the content of each element, "—" indicates that the content is less than a detection limit.

TABLE 3

| | | Solution treatment condition | | | | Copper alloy sheet microstructure | | | | Copper alloy sheet properties | | |
|---|---|---|---|---|---|---|---|---|---|---|---|---|
| Case | No. | Raising temperature speed from room temperature to 400° C. (° C./h) | Raising temperature speed up to solution treatment temperature (° C./s) | Solution treatment temperature (° C.) | Cooling speed after solution treatment (° C./s) | Number density of precipitate (Number/μm²) | Atom concentration of P in precipitate (at %) | Ratio of atom number of P and Si in precipitate (P/Si) | Average grain size (μm) | 0.2% proof strength (MPa) | Electrical conductivity (% IACS) | Bendability |
| Inventive Example | 1 | 50 | 200 | 875 | 300 | 1.5 | 4.1 | 0.3 | 4 | 825 | 43 | ○ |
| | 2 | 50 | 200 | 800 | 300 | 1.5 | 3.4 | 0.3 | 4 | 805 | 45 | ○ |
| | 3 | 50 | 200 | 850 | 200 | 1.3 | 3.7 | 0.4 | 7 | 810 | 44 | ○ |
| | 4 | 50 | 200 | 850 | 200 | 1.3 | 3.7 | 0.5 | 3 | 805 | 43 | ○ |
| | 5 | 50 | 200 | 850 | 200 | 1.4 | 3.5 | 7.1 | 9 | 800 | 40 | ○ |
| | 6 | 50 | 200 | 850 | 200 | 5.3 | 12 | 1 | 6 | 810 | 43 | ○ |
| | 7 | 50 | 200 | 850 | 200 | 1.4 | 0.9 | 0.09 | 8 | 805 | 40 | ○ |
| | 8 | 50 | 200 | 850 | 200 | 1.2 | 3.5 | 0.2 | 5 | 810 | 43 | ○ |
| | 9 | 50 | 200 | 850 | 200 | 0.4 | 3.5 | 0.2 | 9 | 820 | 40 | ○ |
| | 10 | 50 | 200 | 850 | 200 | 1.6 | 3.6 | 0.3 | 4 | 825 | 42 | ○ |
| | 11 | 50 | 200 | 850 | 200 | 1.3 | 3.6 | 0.2 | 7 | 810 | 43 | ○ |
| | 12 | 50 | 200 | 850 | 200 | 1.4 | 3.5 | 0.3 | 6 | 810 | 43 | ○ |
| | 13 | 50 | 200 | 850 | 200 | 1.5 | 3.5 | 0.2 | 4 | 800 | 44 | ○ |
| | 14 | 50 | 200 | 850 | 200 | 1 | 3.7 | 0.2 | 9 | 810 | 40 | ○ |
| | 15 | 50 | 120 | 850 | 200 | 1.6 | 3.6 | 0.2 | 9 | 820 | 40 | ○ |
| | 16 | 50 | 200 | 725 | 200 | 1.5 | 3.4 | 0.3 | 2 | 800 | 45 | ○ |
| | 17 | 50 | 200 | 890 | 200 | 1.1 | 3.4 | 0.3 | 9 | 825 | 40 | ○ |
| | 18 | 50 | 200 | 850 | 70 | 1.2 | 3.5 | 0.3 | 8 | 810 | 40 | ○ |

TABLE 4

| | | Solution treatment condition | | | | Copper alloy sheet microstructure | | | | Copper alloy sheet properties | | |
|---|---|---|---|---|---|---|---|---|---|---|---|---|
| Case | No. | Raising temperature speed from room temperature to 400° C. (° C./h) | Raising temperature speed up to solution treatment temperature (° C./s) | Solution treatment temperature (° C.) | Cooling speed after solution treatment (° C./s) | Number density of precipitate (Number/μm²) | Atom concentration of P in precipitate (at %) | Ratio of atom number of P and Si in precipitate (P/Si) | Average grain size (μm) | 0.2% proof strength (MPa) | Electrical conductivity (% IACS) | Bendability |
| Comparative Example | 19 | 50 | 200 | 850 | 200 | 1.1 | 0 | 0 | 12 | 770 | 40 | x |
| | 20 | 50 | 200 | 850 | 200 | 7.5 | 3.5 | 0.4 | 7 | 810 | 32 | x |
| | 21 | 50 | 200 | 850 | 200 | 0.9 | 4 | 0.4 | 25 | 550 | 55 | x |
| | 22 | 50 | 200 | 850 | 200 | 7.5 | 1.5 | 0.005 | 15 | 800 | 35 | x |
| | 23 | 50 | 200 | 850 | 200 | 0.1 | 20 | 11.2 | 40 | 590 | 35 | x |
| | 24 | 50 | 200 | 850 | 200 | 2.1 | 52 | 3.3 | 6 | 805 | 37 | x |
| | 25 | 50 | 200 | 850 | 200 | 1.5 | 0.08 | 0.3 | 15 | 800 | 40 | x |
| | 26 | 50 | 200 | 850 | 200 | 1.2 | 0.07 | 0.4 | 13 | 770 | 37 | x |
| | 27 | 3 | 200 | 850 | 200 | 7.5 | 3.7 | 0.3 | 6 | 750 | 43 | x |
| | 28 | 130 | 200 | 850 | 200 | 0.4 | 3.6 | 0.3 | 15 | 800 | 40 | x |
| | 29 | 50 | 80 | 850 | 200 | 0.8 | 3.6 | 0.3 | 20 | 810 | 42 | x |
| | 30 | 50 | 200 | 675 | 200 | 9 | 3.6 | 0.4 | 3 | 750 | 43 | x |
| | 31 | 50 | 200 | 925 | 200 | 0.1 | 0.2 | 0.09 | 60 | 810 | 37 | x |
| | 32 | 50 | 200 | 850 | 30 | 8 | 3.5 | 0.4 | 20 | 760 | 43 | x |
| | 33 | 200 | 200 | 900 | 200 | 0.1 | — | — | 30 | 930 | 20 | x |
| | 34 | 200 | 200 | 850 | 200 | 0.1 | 1 | 0.5 | 18 | 700 | 45 | x |
| | 35 | 200 | 200 | 900 | 200 | 0.1 | — | — | 30 | 920 | 18 | x |

Subsequently, second example of the invention will be described. After varying the average grain size of a Cu alloy sheet acquired under the condition that a Cu alloy composition, a production method thereof, and particularly a solution treatment condition are varied and Cr average atom concentration and the like of the precipitate in the microstructure of the Cu alloy are varied, strength, electrical conductivity, bendability, and the like are evaluated, respectively.

Specifically, each copper alloy having the chemical element composition shown in Table 5 was melted in a kryptol furnace in the state where the copper alloy is coated with coal at the atmosphere, the copper alloy was molded in a cast-iron book mold, and thus an ingot of 50 mm in thickness, 75 mm in width, and 180 mm in length was obtained. The surface of each ingot was subjected to a facing. Thereafter, hot rolling was performed at 950° C. to prepare a sheet of 20 mm in thickness, and the resulting sheet was quenched in water from a hot rolling finishing temperature of 750° C. or more. Next, oxidized scale was removed and, thereafter, the primary cold rolling was performed, and thus obtaining copper alloy sheet of 0.25 mm in thickness.

Subsequently, as shown in Table 6, the solution treatment was performed by variously varying the raising temperature and cooling conditions using a salt bath. Additionally, the copper alloy sheet was commonly held at the solution temperature for 30 seconds. A finish cold rolling was performed to thereby yield a cold rolled sheet of about 0.20 mm in thickness. An artificial age-hardening process of 450° C.×4 h was performed to the cold rolled sheet, and thus obtaining a final copper alloy sheet.

In each example, samples were cut from the thus produced copper alloy sheet, and by using the samples, a microstructure investigation, a strength (0.2% proof strength) measurement via a tensile test, an electrical conductivity measurement, and a bending test were performed. The results are shown in Table 6.

In each copper alloy shown in Table 5, the remainder other than described element contents was Cu, and impurity elements such as Mn, Ca, Ag, Cd, Be, Au, Pt, S, Pb, and P other than described element contents shown in Table 5 were specified to be 0.5% or less in total. Besides, elements such as Hf, Th, Li, Na, K, Sr, Pd, W, Nb, Al, V, Y, Mo, In, Ga, Ge, As, Sb, Bi, Te, B, C, and MM (Mischmetal) were specified to be 0.1% or less.

(Microstructure Investigation)

In the microstructure investigation of the copper alloy sample, the average atom concentration (at %) of Cr contained in the precipitate having a size of 50 to 200 nm, the average atom number ratio Cr/Si of Cr and Si contained in the precipitate having the same size of 50 to 200 nm, and the average number density (per μm) of the precipitate having the same size of 50 to 200 nm were measured on the basis of the above-mentioned methods, respectively.

Additionally, when the number of grains and the grain size of the microstructure of the copper alloy sample were referred to n and x, the average grain size (μm) expressed by $(\Sigma x)/n$ was measured by a crystal orientation analysis method in which a backscattered electron diffraction image system is mounted on the field emission scanning electron microscope. Specifically, a mechanical polishing, a buffing, and an electrolytic polishing were performed to the rolling surface of the copper alloy, and thus preparing a sample in which its surface was adjusted. Subsequently, a crystal orientation and a grain size were measured by EBSP using FESEM (JEOL JSM 5410) manufactured by NEC Corporation. The measured area is 300 μm×300 μm, and the measurement step was specified to be every 0.5 μm. An EB SP measurement and analysis system was performed using EBSP manufactured by TSL Corporation (OIM).

(Tensile Test)

In the tensile test, JIS13 B sample in which a test piece's length direction coincides with a rolling direction was used, 0.2% proof strength (MPa) was performed using 5882-type universal testing machine manufactured by Instron Corporation at room temperature under a condition that a test speed is 10.0 mm/min and GL is 50 mm. Under the same condition, three test pieces were tested and the average of them was adopted.

(Electrical Conductivity Measurement)

The copper alloy sheet sample was processed into a slip-shaped test piece of 10 mm in width and 300 mm in length by milling, an electric resistance was measured with a double bridge resistance meter, and the electrical conductivity was calculated by an average cross-sectional area method. Under the same condition, three test pieces were tested and the average of them was adopted.

(Evaluation Test of Bending Workability)

A bending test of the copper alloy sheet sample was performed in conformity with Japan Copper and Brass Association Standard. A test piece of 10 mm in width and 30 mm in length was taken from each sample, Good Way bending (the bending axis is perpendicular to the rolling direction) was performed at a bending radius of 0.15 mm by applying 1000 kgf of load thereto, and the presence or absence of cracking at the bending portion was visually observed under an optical microscope at a magnification of 50. At this time, samples having no crack are indicated by o, and samples having a crack are indicated by x. When the result is excellent in the bending test, bendability is also good enough to endure the sharp bending or 90° bending after notching and the like.

As was clear from Table 6, with regard to copper alloys of Inventive Examples 36 to 47 which had compositions within the range of the invention, solution treatment was performed under preferable conditions, and thus obtaining a product copper alloy sheet.

For this reason, in microstructures of Inventive Examples 36 to 47, on the basis of the above-mentioned measurement methods, the average number density of the precipitates in the range of 50 to 200 nm was in the range of 0.2 to 20 per $\mu m^2$, the average atom concentration of Cr contained in the precipitates having the same size was in the range of 0.1 to 80 at %, and the average grain size was 30 μm or less. Additionally, the average atom number ratio Cr/Si of Cr and Si contained in the precipitate having a size of 50 to 200 nm was in the range of 0.01 to 10.

As a result, Inventive Examples 36 to 47 had 0.2% proof strength of 800 MPa or more and electrical conductivity of 40% IACS or more, which were high strength and high electrical conductivity. Additionally, Inventive Examples had excellent bendability.

On the other hand, in the copper alloys of Comparative Examples 48 to 55, as shown in Table 5, the chemical compound compositions were out of the range that the invention specified. For this reason, even though the solution treatment (production method) was performed within a preferable condition range, the bendability was low for each Comparative Example, and thus the strength and electrical conductivity were also low.

In the copper alloy of Comparative Example 48, Cr was not contained. For this reason, the precipitate (number density) having a size of 50 to 200 nm was small and the average grain size was as large as more than 30 μm. For this reason, the bendability and strength were low.

In the copper alloy of Comparative Example 49, the Cr content largely exceeded the upper limit thereof. For this reason, the precipitate was large. So, bendability was low as well as the atom concentration or the ratio Cr/Si of Cr contained in the precipitate was too large, and thus the electrical conductivity was low.

In the copper alloy of Comparative Example 50, the Ni content largely exceeded the upper limit thereof. For this reason, the bendability and electrical conductivity were outstandingly low.

In the copper alloy of Comparative Example 51, the Ni content largely exceeded the lower limit thereof. For this reason, the precipitate (number density) having a size of 50 to 200 nm was low and the average grain size was as large as more than 30 μm. As a result, the bendability and strength were outstandingly low.

In the copper alloy of Comparative Example 52, the Si content largely exceeded the upper limit thereof. For this reason, the ratio Cr/Si contained in the precipitate having a size of 50 to 200 nm was too small, and the average grain size was large as more than 30 μm. As a result, the bendability and electrical conductivity were outstandingly low.

In the copper alloy of Comparative Example 53, the Si content largely exceeded the lower limit thereof. For this reason, the number density of the precipitate having a size of 50 to 200 nm was too small. So, the ratio Cr/Si contained in the precipitate having the same size was too large and the average grain size was as large as more than 30 μm. As a result, the bendability and strength were outstandingly low.

In the copper alloy of Comparative Example 54, Zr content is too large. For this reason, the average grain size was as large as more than 30 μm. As a result, the bendability and electrical conductivity were outstandingly low.

In the copper alloy of Comparative Example 55, the total content of Fe and Mg was too large. For this reason, the average grain size was as large as more than 30 μm. As a result, the bendability and electrical conductivity were outstandingly low.

In the copper alloy of Comparative Examples 56 to 61, as the examples 56 to 61 shown in Table 5, the chemical element composition was in the specific range of the invention. However, the solution treatment condition (production method) was out of the preferable condition range. As a result, the bendability was low for each Comparative Example, and thus the strength and electrical conductivity were low.

In the solution treatment of Comparative Example 56, the average raising temperature speed was too low up to 400° C. For this reason, the grain growth was promoted, and the average grain size was as large as more than 30 μm. As a result, the bendability and strength were outstandingly low.

In the solution treatment of Comparative Example 57, the average raising temperature speed was too high up to 400° C. For this reason, the number density of the precipitate is insufficient, the average grain size was large, and thus bendability was low.

In Comparative Example 58, the average raising temperature speed was too low from 400° C. to the solution temperature. For this reason, the average grain size was large, and thus bendability was low.

In Comparative Example 59, the solution treatment temperature was too low. For this reason, the solution was incomplete, and thus strength and bendability were low.

In Comparative Example 60, the solution treatment temperature was too high. For this reason, the number density of the precipitate having a size of 50 to 200 nm was too small, and the average grain size was as large as more than 30 μm. As a result, the bendability and electrical conductivity were low.

In Comparative Example 61, the average cooling speed was too small after the solution treatment. For this reason, the grain growth was promoted and thus the average grain size was large as well as bendability was low. Further, strength was low.

Figure 2:
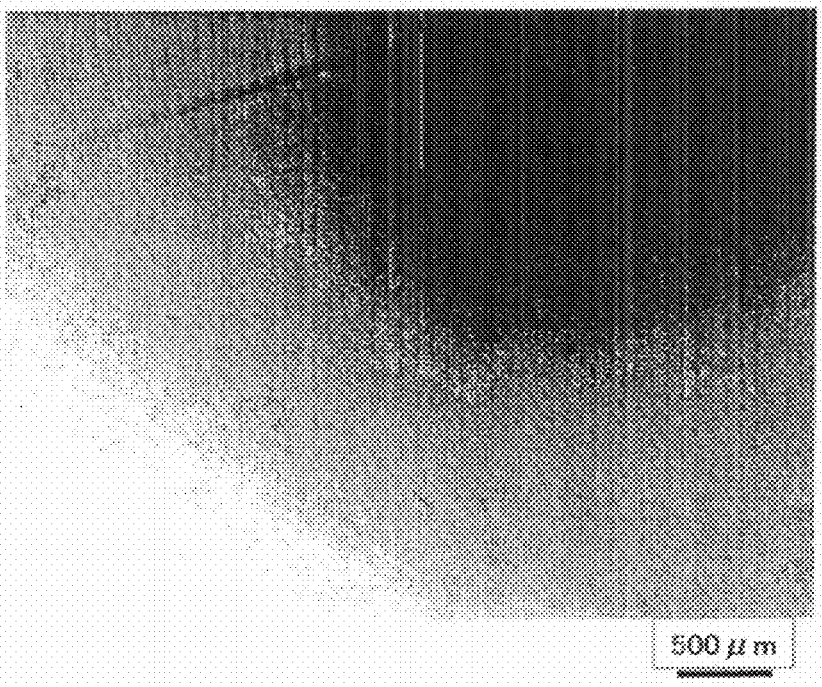
FIG. 2 is a drawing-substituting TEM photograph of a microstructure of a copper alloy sheet according to Comparative Example.

FIGS. 1 and 2 are TEM (Transmission Electron Microscope) photographs taken at a magnification of 50,000 showing the microstructure of the copper alloy sheets of Inventive Example 36 and Comparative Example 48, respectively in the state between the solution treatment at 900° C. and the finish cold rolling. In Inventive Example 36 with Cr shown in FIG. 1, there are black dots indicated by an arrow 1, in which the Cr-containing precipitates are specified (identified) using the EDX. On the other hand, in Comparative Example 48 without Cr shown in FIG. 2, there are not any black dots representing the Cr-containing precipitate.

The above-described facts corroborate the reaction and the effect of the Cr-containing precipitate of the invention. That is, even when the solution treatment temperature is high, the Cr-containing precipitate are not completely contained in a solid solution state and remains in a form of the precipitate among the microstructure, and thus exhibiting the pinning effect for restraining the grain growth. Moreover, the pinning effect for restraining the grain growth of the Cr-containing precipitate of the invention is outstandingly larger than that of the known $Ni_2Si$-based precipitate in which Cr and the Cr-containing precipitate are not contained.

Furthermore, it is shown that the magnitude of the pinning effect of the Cr-containing precipitate is greatly dependent on the average atom concentration of Cr contained in the precipitate having a size of 50 to 200 nm and the number density of the precipitate having the same size.

Therefore, the above-described results corroborate the significance of the critical chemical element composition and microstructure of the copper alloy sheet of the invention and the significance of preferable production conditions to attain the microstructure to achieve high strength and high electrical conductivity as well as excellent bendability.

TABLE 5

| | | Chemical compound composition of copper alloy sheet (remainder: Cu and impurities) | | | | | | |
|---|---|---|---|---|---|---|---|---|
| Case | No. | Ni | Si | Cr | Zn | Sn | Ti, Fe, Mg, Co, Zr | Comment |
| Inventive | 36 | 3.3 | 0.70 | 0.10 | — | — | — | |
| Example | 37 | 3.5 | 0.75 | 0.10 | 1.0 | — | — | |
| | 38 | 2.5 | 0.50 | 0.10 | 1.5 | 1.0 | — | |
| | 39 | 4.0 | 0.80 | 0.50 | 1.0 | 0.20 | — | Upper Limit of Ni |
| | 40 | 3.8 | 1.0 | 0.10 | — | — | — | Upper Limit of Si |
| | 41 | 3.5 | 0.75 | 1.0 | — | — | — | Upper Limit of Cr |
| | 42 | 3.5 | 0.75 | 0.005 | — | 0.20 | — | Lower Limit of Cr |
| | 43 | 3.7 | 0.75 | 0.10 | 0.20 | — | Ti: 0.10 | |
| | 44 | 3.7 | 0.75 | 0.10 | — | 0.10 | Mg: 0.10, Zr: 0.50 | |
| | 45 | 3.7 | 0.75 | 0.10 | 0.10 | 0.10 | Fe: 0.50, Co: 0.05 | |
| | 46 | 3.7 | 0.75 | 0.10 | — | — | Ti: 0.30, Fe: 1.0, Zr: 0.05 | Lower Limit of NiSi |
| | 47 | 0.4 | 0.05 | 0.10 | 2.5 | 4.0 | — | |
| Comparative | 48 | 3.3 | 0.70 | — | 0.50 | — | — | Inexistence of Cr |
| Example | 49 | 3.3 | 0.70 | 1.2 | — | — | — | Excess of Cr |
| | 50 | 4.3 | 0.80 | 0.10 | — | 0.10 | — | Excess of Ni |
| | 51 | 0.30 | 0.50 | 0.10 | — | — | — | Shortage of Ni |
| | 52 | 3.7 | 1.1 | 0.10 | 0.20 | — | — | Excess of Si |
| | 53 | 3.3 | 0.03 | 0.10 | — | — | — | Shortage of Si |

TABLE 5-continued

| Case | No. | Chemical compound composition of copper alloy sheet (remainder: Cu and impurities) Ni | Si | Cr | Zn | Sn | Ti, Fe, Mg, Co, Zr | Comment |
|---|---|---|---|---|---|---|---|---|
| | 54 | 3.3 | 0.70 | 0.10 | 0.50 | — | Zr: 4.0 | Excess of Zr |
| | 55 | 3.3 | 0.70 | 0.10 | — | — | Fe: 2.0, Mg: 1.5 | Excess of FeMg |
| | 56 | 3.3 | 0.70 | 0.10 | — | — | — | |
| | 57 | 3.3 | 0.70 | 0.10 | — | 0.20 | — | |
| | 58 | 3.3 | 0.70 | 0.10 | 1.0 | 0.20 | — | |
| | 59 | 3.3 | 0.70 | 0.10 | — | — | Co: 0.05 | |
| | 60 | 3.3 | 0.70 | 0.10 | 1.5 | 0.50 | Fe: 0.05 | |
| | 61 | 3.3 | 0.70 | 0.10 | — | — | Ti: 0.10, Zr: 0.30 | |

TABLE 6

| Case | No | Solution treatment condition: Raising temperature speed from room temperature to 400° C. (° C./h) | Raising temperature speed up to solution treatment temperature (° C./s) | Solution treatment temperature (° C.) | Cooling speed after solution treatment (° C./s) | Copper alloy sheet microstructure: Number density of precipitate (Number/μm²) | Atom concentration of P in precipitate (at %) | Atom number ratio of P and Si in precipitate (Cr/Si) | Average grain size (μm) | Copper alloy sheet properties: 0.2% proof strength (MPa) | Electrical conductivity (% IACS) | Bendability |
|---|---|---|---|---|---|---|---|---|---|---|---|---|
| Inventive Example | 36 | 50 | 200 | 900 | 200 | 1.2 | 10 | 0.5 | 26 | 820 | 42 | ○ |
| | 37 | 50 | 200 | 850 | 200 | 5.4 | 5.5 | 0.3 | 6 | 805 | 43 | ○ |
| | 38 | 50 | 200 | 750 | 100 | 4.0 | 37 | 2.5 | 4 | 800 | 42 | ○ |
| | 39 | 50 | 150 | 920 | 200 | 3.5 | 26 | 3.2 | 15 | 840 | 41 | ○ |
| | 40 | 50 | 200 | 900 | 200 | 4.3 | 8.7 | 0.2 | 17 | 830 | 40 | ○ |
| | 41 | 50 | 120 | 850 | 200 | 12 | 45 | 7.0 | 3 | 815 | 42 | ○ |
| | 42 | 50 | 200 | 850 | 150 | 1.9 | 0.4 | 0.1 | 8 | 800 | 44 | ○ |
| | 43 | 50 | 200 | 900 | 200 | 2.4 | 7.5 | 0.3 | 13 | 830 | 41 | ○ |
| | 44 | 50 | 150 | 900 | 200 | 2.8 | 5.6 | 0.2 | 10 | 825 | 40 | ○ |
| | 45 | 80 | 200 | 900 | 200 | 2.7 | 5.4 | 0.2 | 11 | 830 | 40 | ○ |
| | 46 | 50 | 200 | 900 | 70 | 5.0 | 3.5 | 0.1 | 8 | 840 | 40 | ○ |
| | 47 | 50 | 200 | 700 | 200 | 0.4 | 28 | 3.0 | 6 | 800 | 42 | ○ |
| Comparative Example | 48 | 50 | 200 | 900 | 200 | 0 | — | — | 56 | 770 | 41 | x |
| | 49 | 50 | 200 | 900 | 200 | 4.5 | 83 | 11 | 35 | 750 | 37 | x |
| | 50 | 50 | 120 | 900 | 200 | 1.6 | 8.0 | 0.4 | 21 | 800 | 34 | x |
| | 51 | 50 | 200 | 900 | 200 | 0.1 | 70 | 1.0 | 43 | 580 | 52 | x |
| | 52 | 50 | 200 | 900 | 200 | 4.5 | 7.7 | 0.007 | 38 | 770 | 36 | x |
| | 53 | 50 | 200 | 900 | 200 | 0.1 | 48 | 12 | 45 | 650 | 45 | x |
| | 54 | 50 | 200 | 900 | 200 | 15 | 0.07 | 0.03 | 34 | 765 | 35 | x |
| | 55 | 50 | 200 | 900 | 200 | 13 | 0.08 | 0.03 | 32 | 780 | 34 | x |
| | 56 | 3 | 120 | 900 | 200 | 1.4 | 9.0 | 0.4 | 37 | 750 | 42 | x |
| | 57 | 130 | 200 | 900 | 200 | 0.1 | 12 | 0.6 | 35 | 800 | 42 | x |
| | 58 | 50 | 80 | 900 | 200 | 1.0 | 10 | 0.5 | 40 | 810 | 41 | x |
| | 59 | 50 | 200 | 650 | 200 | 11 | 5.9 | 0.3 | 5 | 745 | 42 | x |
| | 60 | 50 | 200 | 1000 | 200 | 0 | — | — | 120 | 780 | 43 | x |
| | 61 | 50 | 200 | 900 | 30 | 1.5 | 9.3 | 0.4 | 42 | 765 | 42 | x |

Subsequently, third example of the invention will be described. After varying the average grain size of a Cu alloy sheet acquired under the condition that a Cu alloy composition, a production method thereof; and particularly a solution treatment condition are varied and Ti average atom concentration and the like of the precipitate in the microstructure of the Cu alloy are varied, strength, electrical conductivity, bendability, and the like are evaluated, respectively.

Specifically, each copper alloy having the chemical compound composition shown in Table 7 was melted in a kryptol furnace in the state where the copper alloy is coated with coal at the atmosphere, the copper alloy was molded in a cast-iron book mold, and thus an ingot of 50 mm in thickness, 75 mm in width, and 180 mm in length was obtained. The surface of each ingot was subjected to a facing. Thereafter, hot rolling was performed at 950° C. to prepare a sheet of 20 mm in thickness, and the resulting sheet was quenched in water from a hot rolling finishing temperature of 750° C. or more. Next, oxidized scale was removed and, thereafter, the primary cold rolling was performed, and thus a copper alloy sheet of 0.25 mm in thickness was obtained.

Subsequently, as shown in Table 8, the solution treatment was performed by variously varying the raising temperature and cooling conditions using a salt bath. Additionally, the copper alloy sheet was commonly held at the solution temperature for 30 seconds. A finish cold rolling was performed to thereby yield a cold rolled sheet of about 0.20 mm in thickness. An artificial age-hardening process of 450° C.×4 h was performed to the cold rolled sheet, and thus a final copper alloy sheet was obtained.

In each example, samples were cut from the thus produced copper alloy sheet, and by using the samples, a microstructure investigation, a strength (0.2% proof strength) measurement via a tensile test, an electrical conductivity measurement, and a bending test were performed. The results are shown in Table 8.

In each copper alloy shown in Table 7, the remainder other than described element contents was Cu, and impurity elements such as Mn, Ca, Ag, Cd, Be, Au, Pt, S, Pb, and P other than described element contents shown in Table 7 were specified to be 0.5% or less in total. Besides, elements such as Hf, Th, Li, Na, K, Sr, Pd, W, Nb, Al, V, Y, Mo, In, Ga, Ge, As, Sb, Bi, Te, B, C, and MM (Mischmetal) were specified to be 0.1% or less.

(Microstructure Investigation)

In the microstructure investigation of the copper alloy sample, the average atom concentration (at %) of Ti contained in the precipitate having a size of 50 to 200 nm, the average atom number ratio Ti/Si of Ti and Si contained in the precipitate having the same size of 50 to 200 nm, and the average number density (per $\mu m^2$) of the precipitate having the same size of 50 to 200 nm were measured on the basis of the above-mentioned methods, respectively.

Additionally, when the number of grains and the grain size of the microstructure of the copper alloy sample were referred to n and x, the average grain size (μm) expressed by $(\Sigma x)/n$ was measured by a crystal orientation analysis method in which a backscattered electron diffraction image system is mounted on the field emission scanning electron microscope. Specifically, a mechanical polishing, a buffing, and an electrolytic polishing were performed to the rolling surface of the copper alloy, and thus preparing a sample in which its surface was adjusted. Subsequently, a crystal orientation and a grain size were measured by EBSP using FESEM (JEOL JSM 5410) manufactured by NEC Corporation. The measured area is 300 μm×300 μm, and the measurement step was specified to be every 0.5 μm. An EBSP measurement and analysis system was performed using EBSP manufactured by TSL Corporation (OIM).

(Tensile Test)

In the tensile test, JIS13 B sample in which a test piece's length direction coincides with a rolling direction was used, 0.2% proof strength (MPa) was performed using 5882-type universal testing machine manufactured by Instron Corporation at room temperature under a condition that a test speed is 10.0 mm/min and GL is 50 mm. Under the same condition, three test pieces were tested and the average of them was adopted.

(Electrical Conductivity Measurement)

The copper alloy sheet sample was processed into a slip-shaped test piece of 10 mm in width and 300 mm in length by milling, an electric resistance was measured with a double bridge resistance meter, and the electrical conductivity was calculated by an average cross-sectional area method. Under the same condition, three test pieces were tested and the average of them was adopted.

(Evaluation Test of Bending Workability)

A bending test of the copper alloy sheet sample was performed in conformity with Japan Copper and Brass Association Standard. A test piece of 10 mm in width and 30 mm in length was taken from each sample, Good Way bending (the bending axis is perpendicular to the rolling direction) was performed at a bending radius of 0.15 mm by applying 1,000 kgf of load thereto, and the presence or absence of cracking at the bending portion was visually observed under an optical microscope at a magnification of 50. At this time, samples having no crack are indicated by 0, and samples having a crack are indicated by x. When the result is excellent in the bending test, bendability is also good enough to endure the sharp bending or 90° bending after notching and the like.

As was clear from Table 8, with regard to copper alloys of Inventive Examples 62 to 72 which had compositions within the range of the invention, solution treatment was performed under preferable conditions, and thus obtaining a product copper alloy sheet.

For this reason, in microstructures of Inventive Examples 62 to 72, on the basis of the above-mentioned measurement methods, the average number density of the precipitates in the range of 50 to 200 nm was in the range of 0.2 to 20 per $\mu m^2$, the average atom concentration of Ti contained in the precipitates having the same size was in the range of 0.1 to 50 at %, and the average grain size was 20 μm or less. Additionally, the average atom number ratio Ti/Si of Ti and Si contained in the precipitate having a size of 50 to 200 nm was in the range of 0.01 to 10.

As a result, Inventive Examples 62 to 72 had 0.2% proof strength of 800 MPa or more and electrical conductivity of 40% IACS or more, which were high strength and high electrical conductivity. Additionally, Inventive Examples had excellent bendability.

On the other hand, in the copper alloys of Comparative Examples 73 to 80, as shown in Table 7 the chemical element compositions were out of the range that the invention specified. For this reason, even though the solution treatment (production method) was performed within a preferable condition range, the bendability was low for each Comparative Example, and thus the strength and electrical conductivity were also low.

In the copper alloy of Comparative Example 73, Ti was not contained. For this reason, the precipitate (number density) having a size of 50 to 200 nm was small and the average grain size was as large as more than 20 μm. For this reason, the bendability and strength were low.

In the copper alloy of Comparative Example 74, the Ti content largely exceeded the upper limit thereof. For this reason, the precipitate was large. So, bendability was low as well as the atom concentration or the ratio Ti/Si of Ti contained in the precipitate was too large, and thus the electrical conductivity was low.

In the copper alloy of Comparative Example 75, the Ni content largely exceeded the upper limit thereof. For this reason, the bendability and electrical conductivity were outstandingly low.

In the copper alloy of Comparative Example 76, the Ni content largely exceeded the lower limit thereof. For this reason, the precipitate (number density) having a size of 50 to 200 nm was low and the average grain size was as large as more than 20 μm. As a result, the bendability and strength were outstandingly low.

In the copper alloy of Comparative Example 77, the Si content largely exceeded the upper limit thereof. For this reason, the ratio Ti/Si in the precipitate having a size of 50 to 200 nm was too small, and the average grain size was large as more than 20 μM. As a result, the bendability and electrical conductivity were outstandingly low.

In the copper alloy of Comparative Example 78, the Si content largely exceeded the lower limit thereof. For this reason, the number density of the precipitate having a size of 50 to 200 nm was too small. So, the ratio Ti/Si contained in the precipitate having the same size was too large and the average grain size was as large as more than 20 μm. As a result, the bendability and strength were outstandingly low.

In the copper alloy of Comparative Example 79, the Zr content largely exceeded the upper limit thereof. For this reason, the average grain size was as large as more than 20 μm. As a result, the bendability and electrical conductivity were outstandingly low.

In the copper alloy of Comparative Example 80, the total content of Fe and Co was too large. For this reason, the average grain size was as large as more than 20 μm. As a result, the bendability and electrical conductivity were outstandingly low.

In the copper alloy of Comparative Examples 81 to 86, as the examples 81 to 86 shown in Table 7, the chemical element composition was in the specific range of the invention. However, the solution treatment condition (production method) was out of the preferable condition range. As a result, the bendability was low for each Comparative Example, and thus the strength and electrical conductivity were low.

In the solution treatment of Comparative Example 81, the average raising temperature speed was too low up to 400° C. For this reason, the grain growth was promoted, and the average grain size was as large as more than 20 μm. As a result, the bendability and strength were outstandingly low.

In the solution treatment of Comparative Example 82, the average raising temperature speed was too high up to 400° C. For this reason, the number density of the precipitate is insufficient, the average grain size was large, and thus bendability was low.

In Comparative Example 83, the average raising temperature speed was too low from 400° C. to the solution temperature. For this reason, the average grain size was large, and thus bendability was low.

In Comparative Example 84, the solution treatment temperature was too low. For this reason, the solution was incomplete, and thus strength and bendability were low.

In Comparative Example 85, the solution treatment temperature was too high. For this reason, the number density of the precipitate having a size of 50 to 200 nm was too small, and the average grain size was as large as more than 20 μm. As a result, the bendability and electrical conductivity were low.

In Comparative Example 86, the average cooling speed was too low after the solution treatment. For this reason, the grain growth was promoted and thus the average grain size was large as well as bendability was low. Further, strength was low.

Figure 3:
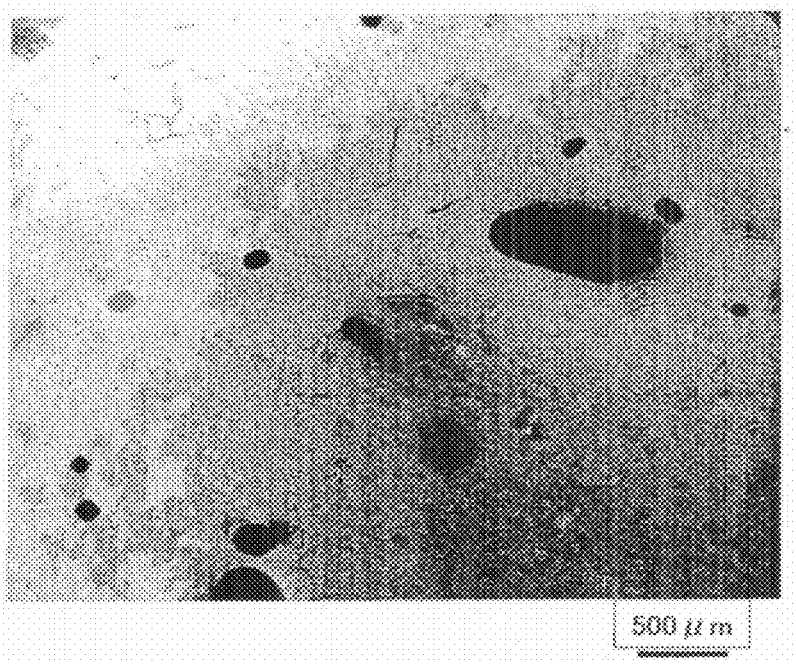
FIG. 3 is the drawing-substituting TEM photograph of the microstructure of the copper alloy sheet according to the invention.
Figure 4:
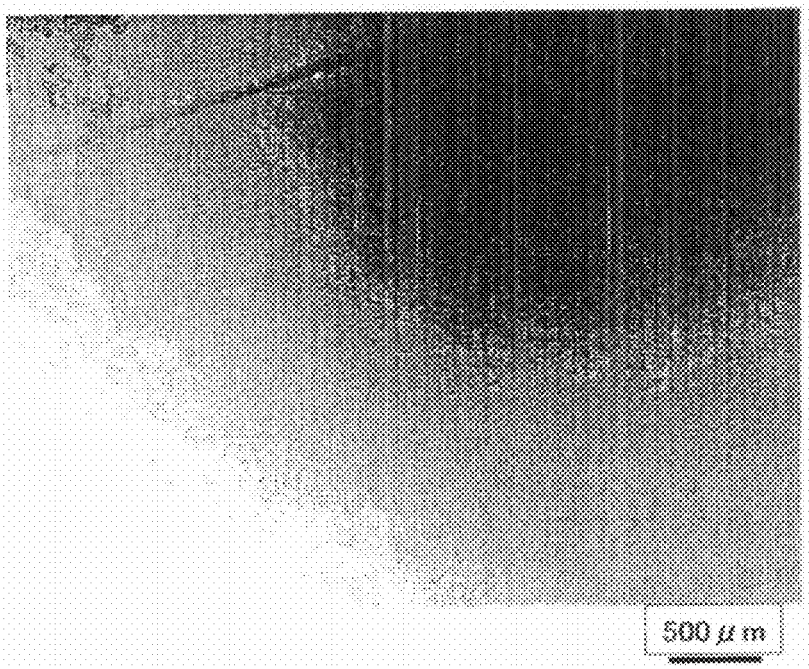
FIG. 4 is the drawing-substituting TEM photograph of the microstructure of the copper alloy sheet according to Comparative Example.

FIGS. 3 and 4 are TEM (Transmission Electron Microscope) photographs taken at a magnification of 50,000 showing the microstructure of the copper alloy sheets of Inventive Example 62 and Comparative Example 73, respectively in the state between the solution treatment at 900° C. and the finish cold rolling. In Inventive Example 62 with Ti shown in FIG. 3, there are black dots indicated by an arrow 1, in which the Ti-containing precipitates are specified (identified) using the EDX. On the other hand, in Comparative Example 73 without Ti shown in FIG. 4, there are not any black dots representing the Ti-containing precipitate.

The above-described facts corroborate the reaction and the effect of the Ti-containing precipitate of the invention. That is, even when the solution treatment temperature is high, the Ti-containing precipitate are not completely contained in a solid solution state and remains in a form of the precipitate among the microstructure, and thus exhibiting the pinning effect for restraining the grain growth. Moreover, the pinning effect for restraining the grain growth of the Ti-containing precipitate of the invention is outstandingly larger than that of the known $Ni_2Si$-based precipitate in which Ti and the Ti-containing precipitate are not contained.

Furthermore, it is shown that the magnitude of the pinning effect of the Ti-containing precipitate is greatly dependent on the average atom concentration of Ti contained in the precipitate having a size of 50 to 200 nm and the number density of the precipitate having the same size.

Therefore, the above-described results corroborate the significance of the critical chemical element composition and microstructure of the copper alloy sheet of the invention and the significance of preferable production conditions to attain the microstructure to achieve high strength and high electrical conductivity as well as excellent bendability.

TABLE 7

| | | Chemical compound composition of copper alloy sheet (remainder: Cu and impurities) | | | | | | |
|---|---|---|---|---|---|---|---|---|
| Case | No. | Ni | Si | Ti | Zn | Sn | Fe, Mg, Co, Zr | Comment |
| Inventive Example | 62 | 3.2 | 0.70 | 0.10 | — | — | — | |
| | 63 | 3.3 | 0.70 | 0.10 | 1.0 | — | — | |
| | 64 | 2.7 | 0.60 | 0.10 | 1.5 | 1.0 | — | |
| | 65 | 4.0 | 0.80 | 0.50 | 0.50 | 0.25 | — | Upper Limit of Ni |
| | 66 | 3.7 | 1.0 | 0.10 | 0.10 | — | — | Upper Limit of Si |
| | 67 | 3.5 | 0.75 | 1.0 | — | 0.10 | — | Upper Limit of Ti |
| | 68 | 3.5 | 0.75 | 0.005 | 0.50 | 0.20 | — | Lower Limit of Ti |
| | 69 | 3.5 | 0.70 | 0.10 | 0.20 | — | Mg: 0.10 | |
| | 70 | 3.5 | 0.70 | 0.10 | — | 0.10 | Co: 0.10, Zr: 0.50 | |
| | 71 | 3.5 | 0.70 | 0.10 | — | — | Fe: 1.0, Mg: 0.10, Co: 0.50 | |
| | 72 | 0.40 | 0.05 | 0.10 | 2.5 | 4.0 | — | Lower Limit of NiSi |
| Comparative Example | 73 | 3.3 | 0.70 | — | 0.50 | — | — | Inexistence of Ti |
| | 74 | 3.2 | 0.70 | 1.2 | — | 0.10 | — | Excess of Ti |
| | 75 | 4.3 | 0.80 | 0.10 | 1.0 | — | — | Excess of Ni |
| | 76 | 0.30 | 0.60 | 0.10 | 0.50 | — | — | Shortage of Ni |
| | 77 | 3.7 | 1.1 | 0.10 | — | — | — | Excess of Si |
| | 78 | 3.2 | 0.03 | 0.10 | — | — | — | Shortage of Si |
| | 79 | 3.2 | 0.70 | 0.10 | 0.50 | 0.10 | Zr: 4.0 | Excess of Zr |
| | 80 | 3.2 | 0.70 | 0.10 | — | — | Fe: 2.0, Co: 1.5 | Excess of FeCo |
| | 81 | 3.2 | 0.70 | 0.10 | — | — | — | |
| | 82 | 3.2 | 0.70 | 0.10 | — | — | — | |
| | 83 | 3.2 | 0.70 | 0.10 | 0.50 | 0.20 | — | |
| | 84 | 3.2 | 0.70 | 0.10 | 0.50 | — | Mg: 0.05 | |
| | 85 | 3.2 | 0.70 | 0.10 | 1.5 | 0.50 | Co: 0.05 | |
| | 86 | 3.2 | 0.70 | 0.10 | — | — | Fe: 0.20, Zr: 0.50 | |

TABLE 8

| | | Solution treatment condition | | | | Copper alloy sheet microstructure | | | | Copper alloy sheet properties | | |
|---|---|---|---|---|---|---|---|---|---|---|---|---|
| Case | No. | Raising temperature speed from room temperature to 400° C. (° C./s) | Raising temperature speed up to solution treatment temperature (° C./h) | Solution treatment temperature (° C.) | Cooling speed after solution treatment (° C./s) | Number density of precipitate (Number/μm$^2$) | Atom concentration of P in precipitate (at %) | Atom number ratio of P and Si in precipitate (Ti/Si) | Average grain size (μm) | 0.2% proof strength (MPa) | Electrical conductivity (% IACS) | Bendability |
| Inventive Example | 62 | 50 | 200 | 900 | 200 | 1.8 | 8.8 | 0.4 | 16 | 815 | 42 | ○ |
| | 63 | 50 | 200 | 850 | 200 | 4.9 | 5.8 | 0.3 | 6 | 800 | 43 | ○ |
| | 64 | 30 | 200 | 750 | 100 | 6.0 | 27 | 2.2 | 5 | 805 | 42 | ○ |
| | 65 | 50 | 150 | 920 | 200 | 3.0 | 20 | 3.1 | 10 | 845 | 40 | ○ |
| | 66 | 50 | 200 | 900 | 200 | 4.4 | 7.9 | 0.10 | 11 | 820 | 41 | ○ |
| | 67 | 50 | 120 | 850 | 200 | 12 | 32 | 6.7 | 4 | 825 | 41 | ○ |
| | 68 | 50 | 200 | 850 | 150 | 2.2 | 1.2 | 0.08 | 7 | 800 | 43 | ○ |
| | 69 | 50 | 200 | 900 | 200 | 2.4 | 7.1 | 0.3 | 9 | 825 | 41 | ○ |
| | 70 | 80 | 200 | 900 | 200 | 2.6 | 5.9 | 0.3 | 8 | 820 | 41 | ○ |
| | 71 | 50 | 200 | 900 | 70 | 4.7 | 4.4 | 0.08 | 7 | 835 | 41 | ○ |
| | 72 | 50 | 200 | 700 | 200 | 0.5 | 21 | 2.9 | 5 | 800 | 42 | ○ |
| Comparative Example | 73 | 50 | 200 | 900 | 200 | 0 | — | — | 56 | 770 | 41 | x |
| | 74 | 50 | 200 | 900 | 200 | 4.5 | 56 | 11 | 22 | 750 | 36 | x |
| | 75 | 50 | 120 | 900 | 200 | 2.0 | 7.5 | 0.3 | 13 | 800 | 35 | x |
| | 76 | 50 | 200 | 900 | 200 | 0.1 | 48 | 1.1 | 25 | 590 | 52 | x |
| | 77 | 50 | 200 | 900 | 200 | 4.4 | 7.3 | 0.006 | 23 | 765 | 37 | x |
| | 78 | 50 | 200 | 900 | 200 | 0.1 | 34 | 12 | 27 | 645 | 45 | x |
| | 79 | 50 | 200 | 900 | 200 | 14 | 0.06 | 0.03 | 22 | 770 | 34 | x |
| | 80 | 50 | 200 | 900 | 200 | 12 | 0.08 | 0.04 | 21 | 760 | 36 | x |
| | 81 | 3 | 120 | 900 | 200 | 1.9 | 8.1 | 0.3 | 23 | 740 | 43 | x |
| | 82 | 130 | 200 | 900 | 200 | 0.1 | 10 | 0.5 | 22 | 790 | 43 | x |
| | 83 | 50 | 80 | 900 | 200 | 1.7 | 8.8 | 0.4 | 24 | 810 | 42 | x |
| | 84 | 50 | 200 | 650 | 200 | 10 | 6.1 | 0.2 | 6 | 745 | 41 | x |
| | 85 | 50 | 200 | 1000 | 200 | 0 | — | — | 92 | 785 | 43 | x |
| | 86 | 50 | 200 | 900 | 30 | 2.0 | 8.3 | 0.3 | 25 | 770 | 41 | x |

While the present invention has been described in detail and with reference to specific embodiments thereof, it will be apparent to one skilled in the art that various changes and modifications can be made therein without departing from the scope thereof.

This application is based on Japanese patent application No. 2006-147088 filed

May 26, 2006, Japanese patent application No. 2006-257534 filed Sep. 22, 2006 and Japanese patent application No. 2006-257535 filed September 22, the entire contents thereof being hereby incorporated by reference.

Further, all references cited herein are incorporated in their entireties.

INDUSTRIAL APPLICABILITY

According to the invention, it is possible to provide a copper alloy having high strength, high electrical conductivity, and excellent bendability. As a result, it is possible to use the copper alloy for IC lead frame, connector, terminal, switch, relay, and the like as well as for IC lead frame for semiconductor device, which require high strength, high electrical conductivity, and excellent bendability, for use in small-size and light-weight electric/electronic components.

The invention claimed is:

1. A copper alloy having high strength, high electrical conductivity, and excellent bendability, said copper alloy comprising, in terms of mass %, 0.4 to 4.0% of Ni; 0.05 to 1.0% of Si; and, as an element M, 0.005 to 1.0% of Ti, with the remainder being copper and inevitable impurities, wherein an atom number ratio M/Si of elements M and Si contained in a precipitate having a size of 50 to 200 nm in a microstructure of the copper alloy is from 0.01 to 10 on average, the atom number ratio being measured by a field emission transmission electron microscope with a magnification of 30,000 and an energy dispersive analyzer wherein a number density of the precipitate having a size of 50 to 200 nm in the microstructure of the copper alloy is from 0.2 to 20 per μm$^2$ on average, the number density being measured by the field emission transmission electron microscope and the energy dispersive analyzer, wherein an average atom concentration of P contained in the precipitate having said size is from 0.1 to 50 at %, and wherein an average grain size represented by $(\Sigma x)/n$ is 20 μm or less, wherein n represents a number of grains and x represents a size of each of the grains, respectively, according to a measurement by a crystal orientation analysis method using a field emission scanning electron microscope and a backscattered electron diffraction image system mounted thereon.

2. The copper alloy according to claim 1, which further comprises, in terms of mass %, one or two or more kinds of Fe, Mg, Co, and Zr in a total amount of 0.01 to 3.0%.

3. The copper alloy according to claim 1, which further comprises, in terms of mass %, 0.005 to 3.0% of Zn.

4. The copper alloy according to claim 1, which further comprises, in terms of mass %, 0.01 to 5.0% of Sn.

* * * * *